US011617931B2

(12) United States Patent
Kim

(10) Patent No.: US 11,617,931 B2
(45) Date of Patent: Apr. 4, 2023

(54) PORTABLE GOLF SWING EXERCISER AND GOLF SWING MOTION INFORMATION PROVIDING DEVICE HAVING THE SAME

(71) Applicant: Jong gi Kim, Incheon (KR)

(72) Inventor: Jong gi Kim, Incheon (KR)

(73) Assignee: Jong gi Kim, Incheon (KR)

( * ) Notice: Subject to any disclaimer, the term of this patent is extended or adjusted under 35 U.S.C. 154(b) by 0 days.

(21) Appl. No.: 16/950,351

(22) Filed: Nov. 17, 2020

(65) Prior Publication Data

US 2022/0040549 A1 Feb. 10, 2022

(30) Foreign Application Priority Data

Aug. 6, 2020 (KR) ..... 10-2020-0098354
Oct. 16, 2020 (KR) ..... 10-2020-0134016

(51) Int. Cl.

| | |
|---|---|
| ***A63B 60/46*** | (2015.01) |
| ***A63B 69/36*** | (2006.01) |
| ***A63B 102/32*** | (2015.01) |
| ***A63B 60/00*** | (2015.01) |
| ***A63B 53/02*** | (2015.01) |

(52) U.S. Cl.

CPC ..... *A63B 60/46* (2015.10); *A63B 53/02* (2013.01); *A63B 60/0085* (2020.08); *A63B 69/3635* (2013.01); *A63B 2102/32* (2015.10); *A63B 2225/74* (2020.08)

(58) Field of Classification Search

CPC . A63B 60/46; A63B 69/3635; A63B 60/0085; A63B 2225/74; A63B 2102/32; A63B 69/3623; A63B 69/3608; A63B 69/0059; A63B 21/0004; A63B 15/00; A63B 1/00; A63B 3/00; A63B 21/06; A63B 21/065; A63B 21/072–075; A63B 21/4001–4021

USPC ..... 473/227, 212–216, 207, 219–222, 473/274–277

See application file for complete search history.

(56) References Cited

U.S. PATENT DOCUMENTS 3,109,244 A * 11/1963 Trifaro ..... A63B 69/3623 473/409
3,191,939 A * 6/1965 Hooper ..... A63B 69/0024 362/102
3,820,781 A * 6/1974 Kane ..... A63B 23/0227 473/409
4,257,591 A * 3/1981 Evans, Sr. ..... A63B 23/0211 482/91
4,693,479 A * 9/1987 McGwire ..... A63B 69/3614 473/220
4,858,934 A * 8/1989 Ladick ..... A63B 69/3614 473/220
5,040,798 A * 8/1991 Leitao ..... A63B 69/0059 473/212
5,190,512 A * 3/1993 Curran ..... A63B 23/00 482/125

(Continued)

*Primary Examiner* — Sebastiano Passaniti
(74) *Attorney, Agent, or Firm* — Bridgeway IP Law Group, PLLC; Jihun Kim

(57) ABSTRACT

A portable golf swing exerciser includes: a main body of a shaft shape; a head shaft including a head, and one or more connection shafts, of which one end is detachably coupled to the head, and the other end is detachably coupled to a front end of the main body; and an antenna stick guide extended from or retracted into a rear end of the main body in a form of an antenna having multiple sections.

6 Claims, 21 Drawing Sheets

(56) References Cited

U.S. PATENT DOCUMENTS

| | | | | | |
|---|---|---|---|---|---|
| 5,269,528 | A * | 12/1993 | McCardle, Jr. | A63B 15/02 | 473/409 |
| 5,529,306 | A * | 6/1996 | Staats | A63B 69/0059 | 473/214 |
| 5,728,006 | A * | 3/1998 | Teitell | A63B 69/3623 | 473/151 |
| 5,890,968 | A * | 4/1999 | Mingo | A63B 69/0059 | 473/212 |
| 5,954,592 | A * | 9/1999 | Laffer | A63B 69/3623 | 473/278 |
| 6,132,322 | A * | 10/2000 | Bonham | A63B 69/0059 | 473/274 |
| 6,206,787 | B1 * | 3/2001 | Kleppen | A63B 69/0059 | 473/212 |
| 6,386,988 | B1 * | 5/2002 | Shearer | A63B 69/3614 | 473/274 |
| 6,503,148 | B2 * | 1/2003 | Lane | A63B 69/3667 | 473/215 |
| 7,322,908 | B2 * | 1/2008 | DiGiacomo | A63B 69/0059 | 482/109 |
| 7,641,566 | B2 * | 1/2010 | O'Connor | A63B 57/20 | 473/274 |
| 9,126,075 | B2 * | 9/2015 | Tomaszewski | A63B 21/4035 | |
| 9,757,634 | B1 * | 9/2017 | Fierro | A63B 69/3623 | |
| 10,926,138 | B2 * | 2/2021 | Laakkonen | G16H 20/30 | |
| 2004/0048679 | A1 * | 3/2004 | Bunting | A63B 69/3632 | 473/226 |
| 2013/0072315 | A1 * | 3/2013 | Fortunato | A63B 69/3608 | 473/409 |
| 2014/0295983 | A1 * | 10/2014 | Nooner | A63B 21/026 | 473/223 |
| 2018/0264323 | A1 * | 9/2018 | Laakkonen | A63B 71/0622 | |

* cited by examiner

PORTABLE GOLF SWING EXERCISER AND GOLF SWING MOTION INFORMATION PROVIDING DEVICE HAVING THE SAME

BACKGROUND OF THE INVENTION

Field of the Invention

The present invention relates to a portable golf swing exerciser and a golf swing motion information providing device having the same, and more specifically, to a portable golf swing exerciser including an antenna stick guide, which is easy to carry and convenient to make a practice, and allows a user to recognize rotational motion of the body during a golf swing, and a golf swing motion information providing device having the same.

Background of the Related Art

Recently, the number of people enjoying golf is increasing rapidly. For example, the number of golf course users in 2018 is 43 million (four times of baseball spectators), the number of screen golf course users is 12 million, and golf population is 7 million, and therefore, it may be said as an era of golf popularization. In particular, as of May 2020, golf courses are in booming despite the outbreak of coronavirus, and the golf clothing market is also growing rapidly. In particular, the number of young people having strong intention of learning golf is increasing rapidly.

In learning golf, it is important to practice golf swing in a desirable way. A golf swing motion is performed by swing back a club to hit (impact) a golf ball and then reaching a downswing impact, and is finished with a release finish by the inertia of the swing.

However, although a person who desires to learn golf swing takes lessons and follows YouTube videos to make the golf swing well, it is difficult to learn the golf swing, and the practice is not continuous as it is difficult to practice anytime, anywhere.

That is, as a golf club is significantly long, it is difficult to carry the golf club at all times, and there are many inconveniences such as having to practice golf swing at a specific location. Therefore, there is a need for a golf swing exerciser that is easy to carry and convenient to practice golf swing anytime, anywhere.

In addition, in learning golf swing, it is important to move or rotate the knees, pelvises, and shoulders in a desirable order and angle in a continuous motion of backswing, downswing, impact, release and finish. The sequential movement or rotational motion of each body part is difficult to learn, and it is difficult to recognize how they actually rotate. Therefore, there is a need for a convenient pelvis trunk golf swing exerciser, which is easy to carry and can be used for making a swing practice anytime anywhere and correcting rotational motions while recognizing the motions by himself or herself.

SUMMARY OF THE INVENTION

Therefore, the present invention has been made in view of the above problems, and it is an object of the present invention to provide a portable golf swing exerciser, which is easy to carry and can be used for making a swing practice anytime anywhere, and is easy to learn and convenient to use.

In addition, another object of the present invention is to provide a portable golf swing exerciser, which can be used by an amateur to learn easily like a pro and make a practice alone while watching a video with only an instruction manual.

In addition, another object of the present invention is to provide a portable golf swing exerciser, which can prevent sway, slice, hand first impact, down blow impact, hitting back ground, and topping.

In addition, another object of the present invention is to provide a portable golf swing exerciser, which can help a user to improve flying distance, learn a consistent swing mechanism, and restore self-esteem.

In addition, another object of the present invention is to provide a portable golf swing exerciser, which allows a user to recognize rotational motions of a body such as knees, pelvises, and shoulders during a golf swing, and a golf swing motion information providing device having the same.

The objects of the present invention are not limited to the objects mentioned above, and unmentioned other objects will be clearly understood by those skilled in the art from the following description.

To accomplish the above objects, according to an embodiment of the present invention, there is provided a portable golf swing exerciser that is easy to carry and use as the length can be adjusted. The portable golf swing exerciser includes: a main body of a shaft shape; a head shaft including a head, and one or more connection shafts, of which one end is detachably coupled to the head, and the other end is detachably coupled to the front end of the main body; and an antenna stick guide extended from or retracted into the rear end of the main body in the form of an antenna having multiple sections.

In an embodiment of the present invention, the antenna stick guide may include: a first stick inserted into the main body having a hollow inside and pulled out from the rear end, or coupled to the rear end of the main body; a second stick pulled out from or inserted into the first stick; and a third stick pulled out from or inserted into the second stick.

In an embodiment of the present invention, the antenna stick guide further may include: a cover unit coupled to the rear end of the third stick to close the rear end of the main body while the first stick, the second stick, and the third stick are inserted; and a laser beam generation unit installed on the head or the cover unit to emit a laser beam to visually confirm a swing trajectory.

In an embodiment of the present invention, the main body may include: a main shaft of a shaft shape, into which the antenna stick guide may be inserted or coupled; and a grip unit coupled to the outer surface of the main shaft and having a grip guide protrusion for guiding a grip position.

In an embodiment of the present invention, the head may include a head body colliding with a golf ball, and a connection rod extending from the head body, and the one or more connection shafts may include: a first connection shaft detachably coupled to the connection rod of the head; and a second connection shaft detachably coupled to the rear end of the first connection shaft and detachably coupled to the front end of the body.

In an embodiment of the present invention, one among the connection rod of the head and the first connection shaft may have a female thread shape and the other one may have a male thread shape to be screw-coupled to each other.

In an embodiment of the present invention, a tightening member may be provided on the connection rod of the head, and the tightening member may be rotation-locked as it is inserted in the first connection shaft and expands while rotating.

In an embodiment of the present invention, a locking groove may be formed in one among the connection rod of the head and the first connection shaft, and a locking protrusion moving along the locking groove may be formed in the other one, and as the locking protrusion is moved along the locking groove, rotation between the connection rod of the head and the first connection shaft may be locked.

In an embodiment of the present invention, the portable golf swing may further include a connection tightening unit for indirectly coupling the connection rod of the head and the first connection shaft, wherein the connection tightening unit may include: a receiving unit into which the first connection shaft and the connection rod of the head are inserted in opposite directions, respectively; pressing units rotatably coupled to the receiving unit and surrounding the receiving unit to press the connection rod of the head and the first connection shaft inserted in the receiving unit; and tightening screws installed on the pressing units.

In an embodiment of the present invention, a fixing protrusion restored by an elastic force may be formed in the connection rod of the head, and a fixing hole through which the fixing protrusion pressed while the connection rod of the head is inserted into the first connection shaft is restored and protrudes may be formed in the first connection shaft.

In an embodiment of the present invention, the portable golf swing may further include a sound generation block inserted in the main body to slide at the moment of downswing, to collide with the rear end of the second connection shaft inserted in the main shaft and generate a sound, and to turn off generation of sound as the sliding is prevented when the second connection shaft is further inserted into the main body as much as a predetermined depth.

To accomplish the above objects, according to another embodiment of the present invention, there is provided a portable pelvis trunk golf swing exerciser that is worn during a golf swing to easily recognize rotational motion of a user's body (However, the present invention is not limited only to body parts such as the pelvis and/or trunk, and it is the same hereinafter).

The portable golf swing exerciser according to another embodiment of the present invention includes: a shaft body positioned to be extended left and right near pelvises or shoulders of a user when the portable golf swing exerciser is worn; a first extension shaft coupled to one end of the shaft body to be extendable; a second extension shaft coupled to the other end of the shaft body to be extendable; two connection belts, one ends of which are connected to the shaft body, respectively, to tightly attach the shaft body to the user's body when tightened; a support pad connected to the other ends of the two connection belts to be tightly attached to the user's body from the opposite side of the shaft body as the two connection belts are tightened, wherein during a golf swing, a shape of rotational motion of the user's body is easily recognized from trajectories of an end portion of the first extension shaft and an end portion of the second extension shaft.

In an embodiment of the present invention, an LED that can be turned on and off by a user may be installed at the end portion of the first extension shaft and the end portion of the second extension shaft.

In an embodiment of the present invention, a laser generator for emitting a beam in a longitudinal direction of the shaft body may be installed at the end portion of the first extension shaft and the end portion of the second extension shaft.

In an embodiment of the present invention, the first extension shaft and the second extension shaft may have a multi-section length adjustment structure that can be inserted in or pulled out in multiple sections to adjust the length.

In an embodiment of the present invention, a connection ring having a fastening hole into which the shaft body is inserted may be formed at an end of each connection belt, and the connection ring may slide along the shaft body.

In an embodiment of the present invention, the exerciser may be worn to position the shaft body at the lower abdomen near the user's pelvises or at the waist near the pelvises.

In an embodiment of the present invention, the exerciser may be worn to position the shaft body on the shoulders near the user's chest or on the back shoulders.

To accomplish the above objects, according to still another embodiment of the present invention, there is provided a golf swing motion information providing device for providing information on the shape of rotational motion of a body during a golf swing practice. The golf swing motion information providing device may include: the portable pelvis trunk golf swing exerciser described above; a trajectory sensor for sensing trajectories of an end portion of a first extension shaft and an end portion of a second extension shaft; and a control unit for analyzing the sensed trajectories and transferring an analysis result to a user.

In an embodiment of the present invention, the trajectory sensor may have a sensing surface for sensing a beam emitted from the laser generator, and the control unit may generate rotational motion shape information including rotation angles of both knees, rotation angles of pelvises, rotation angles of shoulders, and a rotation order of the knees, the pelvises, and the shoulders from user's body information input in advance and the sensed trajectories, and transmit the rotational motion shape information to a user's smartphone.

According to an embodiment of the present invention, there is provided a portable golf swing exerciser, which is easy to carry and can be used for making a swing practice anytime anywhere, and is easy to learn and convenient to use.

In addition, there is provided a portable golf swing exerciser, which can be used by an amateur to learn easily like a pro and make a practice alone while watching a video with only an instruction manual.

In addition, there is provided a portable golf swing exerciser, which can prevent sway, slice, hand first impact, down blow impact, hitting back ground, and topping.

In addition, there is provided a portable golf swing exerciser, which can help a user to improve flying distance, learn a consistent swing mechanism, and restore self-esteem.

According to an embodiment of the present invention, there is provided a portable golf swing exerciser, which allows a user to easily and visually confirm the rotational trajectory of a shaft located on the pelvises or shoulders by emission of laser beams or LED light to recognize rotational motions of the body such as knees, pelvises, and shoulders during a golf swing, and a golf swing motion information providing device having the same.

According to the embodiments of the present invention, it is easy to know how much and how to move or rotate the pelvises and the trunk during a golf swing.

The effects of the present invention are not limited to the effects described above, and should be understood to include all the effects that can be deduced from the configuration of the present invention described in the detailed description or claims of the present invention.

DESCRIPTION OF SYMBOLS

Figure 1:
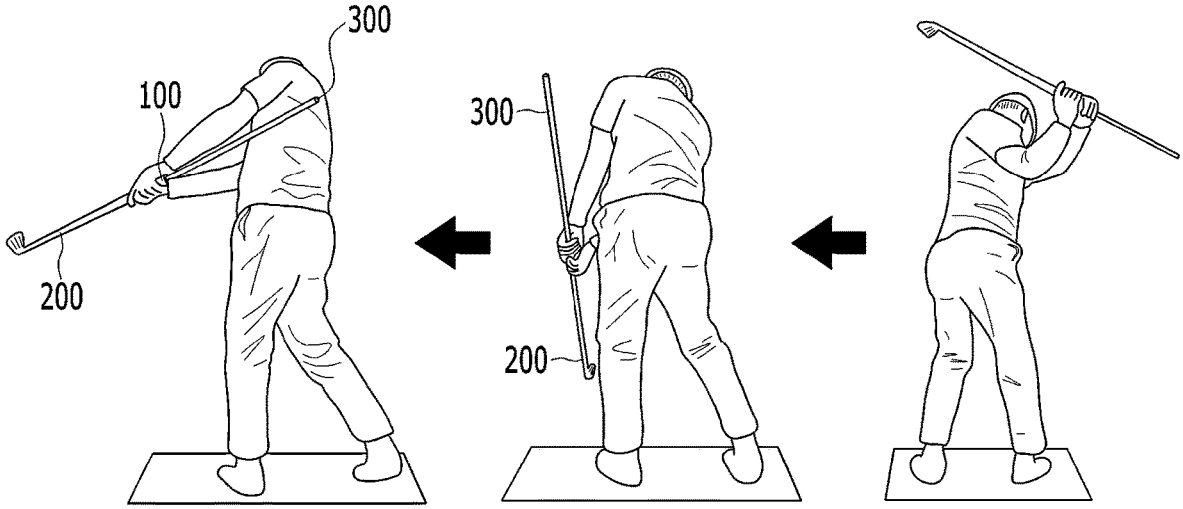
FIG. 1 is a view showing a swing motion using a portable golf swing exerciser according to an embodiment of the present invention.

1: Portable golf swing exerciser
100: Main body
110: Main shaft
111: Sound generation block
120: Grip unit
124: Grip guide protrusion
200: Head shaft
210: Head
211: Head body
212: Head connection rod
220: First connection shift
230: Second connection shift
310: First stick
320: Second stick
330: Third stick
340: Cover unit
2112, 341: Laser beam generation unit
1100: Portable golf swing exerciser
1110: Shaft body
1120: First extension shaft
1121, 1131: First shaft
1122, 1132: Second shaft
1130: Second extension shaft
1140: Connection belt
1141: Connection ring
1150: Supporting pad
1160: LED
1170: Laser generator
1200: Trajectory sensor
1300: Control unit
1400: Smartphone

DETAILED DESCRIPTION OF THE PREFERRED EMBODIMENT

Hereafter, the present invention will be described with reference to the accompanying drawings. However, the present invention may be implemented in various different forms, and accordingly, it is not limited to the embodiments described herein. In the drawings, those elements unrelated to the description are omitted to clearly describe the present invention, and like reference numerals refer to like elements throughout the specification.

Throughout the specification, when an element is "connected to" another element, it includes a case of "indirectly connecting" the elements with intervention of another element therebetween, as well as a case of "directly connecting" the elements. In addition, when an element includes a constitutional component, it means further including the constitutional component, not excluding the constitutional component, as far as an opposed description is not specially specified.

The terms used in this specification are used only to describe specific embodiments, and are not intended to limit the present invention. Singular expressions include plural expressions unless the context clearly indicates otherwise. It should be understood that in this specification, terms such as "comprise" or "have" are intended to designate the presence of features, numbers, steps, operations, components, parts, or combinations thereof described in the specification, and do not preclude in advance the presence or addition of one or more other features, numbers, steps, actions, components, parts, or combinations thereof.

Hereinafter, embodiments of the present invention will be described in detail with reference to the accompanying drawings.

Figure 2:
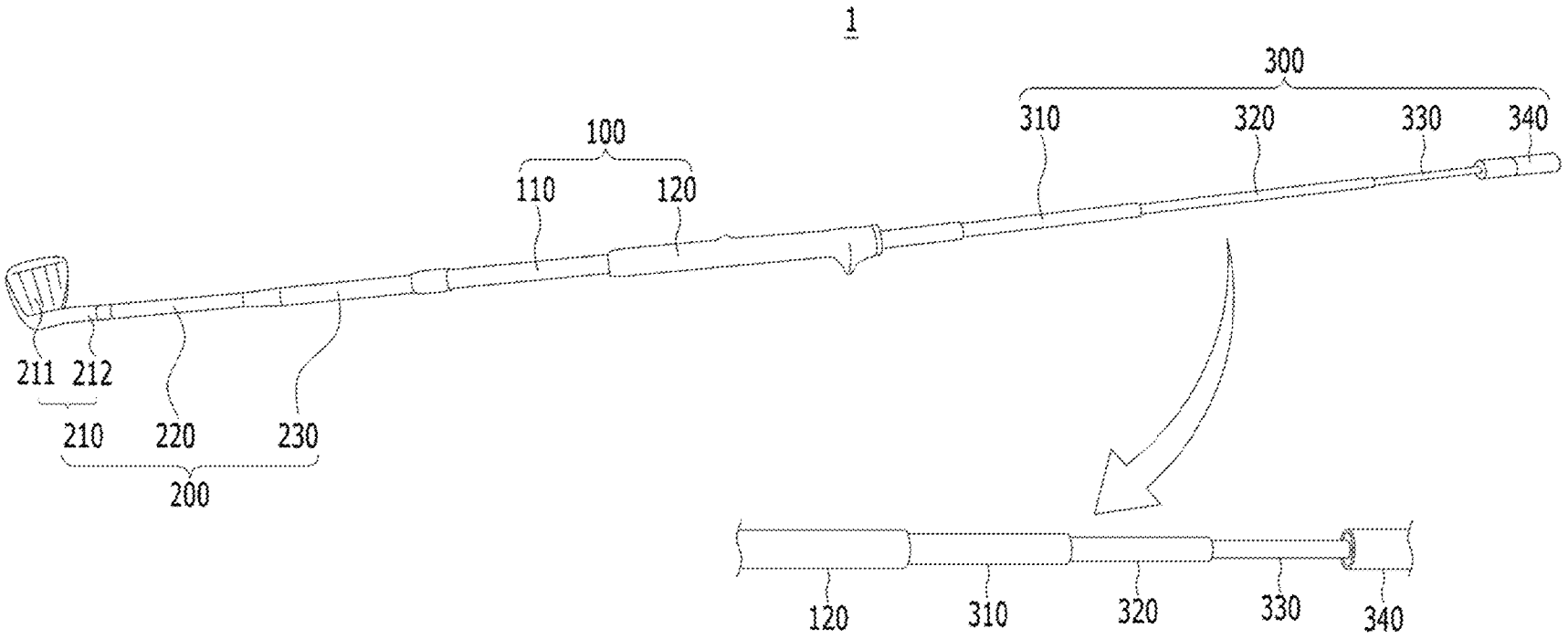
FIG. 2 is a view showing a portable golf swing exerciser according to an embodiment of the present invention.

FIG. 1 is a view showing a swing motion using a portable golf swing exerciser according to an embodiment of the present invention. FIG. 2 is a view showing a portable golf swing exerciser according to an embodiment of the present invention.

A portable golf swing exerciser 1 includes a main body 100 of a shaft shape, a head shaft 200, and an antenna stick guide 300. As the portable golf swing exerciser of this embodiment includes an antenna stick guide and can be adjusted in length, it is easy to carry and use.

Hereinafter, each part will be described in detail.

The main body 100 may include a main shaft 110 and a grip unit 120.

The main shaft 110 may have a shape of a shaft having a hollow inside so that the antenna stick guide 300 may be inserted therein.

The grip unit 120 is a part that a user holds with a hand, and may be coupled to the outer surface of the main shaft 110. The grip unit 120 may be made of a material having a good feeling of grip on the hand.

The head shaft 200 may include a head 210 and one or more connection shafts.

The head 210 may include a head body 211 that a golf ball contacts, and a connection rod 212 extended from the head body 211.

The one or more connection shafts may be detachably coupled to the head 210 at one end and detachably coupled to the front end of the main body 100 at the other end.

The antenna stick guide 300 may be extended from the rear end of the main body 100 in the form of an antenna having multiple sections, or retracted and inserted into the main body 100.

In this embodiment, the antenna stick guide 300 may include a first stick 310 pulled out or inserted in through the rear end of the main body 100 having a hollow inside, a second stick 320 pulled out or inserted in the first stick 310, and a third stick 330 pulled out or inserted in the second stick 320.

The antenna stick guide 300 may further include a cover unit 340 coupled to the rear end of the third stick 330 by closing the rear end of the main body 100 while the first stick 310, the second stick 320, and the third stick 330 are inserted.

When the cover unit 340 is pulled with a hand, the third stick 330 is pulled out from the second stick 320 and the second stick 320 is pulled out from the first stick 310 as if an antenna is extended, and the end of the first stick 310 may be latched and fixed to the rear end of the main shaft 110.

Therefore, when the portable golf swing exerciser is carried, the antenna stick guide 300 is inserted into the main shaft 110 to conveniently carry. The antenna stick guide 300 may not be inserted into the main shaft 110 and may be simply attached to and detached from the rear end of the main shaft 110 in a way of screw-coupling or the like.

As is understood from the swing motion of FIG. 1, as the antenna stick guide 300 moves at a position opposite to the head 210, the antenna stick guide 300 is positioned in front of the feet of the user when the head 210 is raised above the head of the user, and the user may sense the swing motion of lifting the head 210, i.e., a backstroke motion, while seeing the antenna stick guide 300 in front of the eyes, and therefore, it is convenient to practice, and efficiency of practice may be enhanced.

Figure 3:
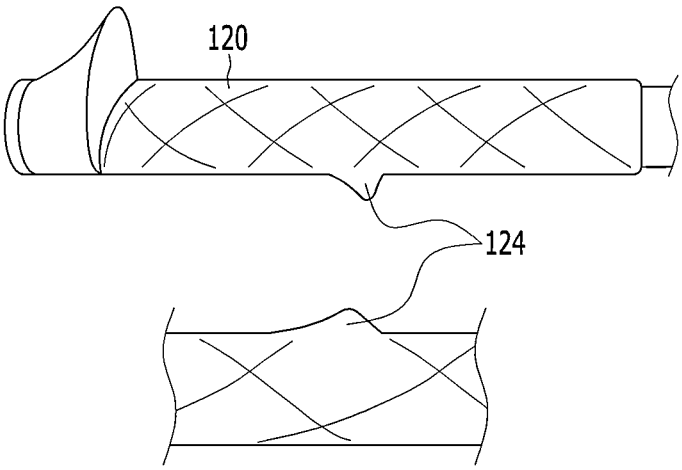
FIG. 3 is a view showing a grip guide protrusion of a grip unit of a main body.

FIG. 3 is a view showing a grip guide protrusion 124 of a grip unit 120 of the main body 100.

A grip guide protrusion 124 for guiding a grip position may be formed in the grip unit 120 of the main body 100. The grip guide protrusion 124 is a thin triangular protrusion and allows a user to know the position and the angle that the user holds the grip, i.e., the angle of the main body 100 rotating from a reference. Therefore, the user may get help in holding the grip at a desired angle (the angle of rotating around the shaft).

That is, a user may learn a correct gripping method such as weak (W), neutral (N), and strong (S) using the grip guide protrusion 124.

Figure 4:
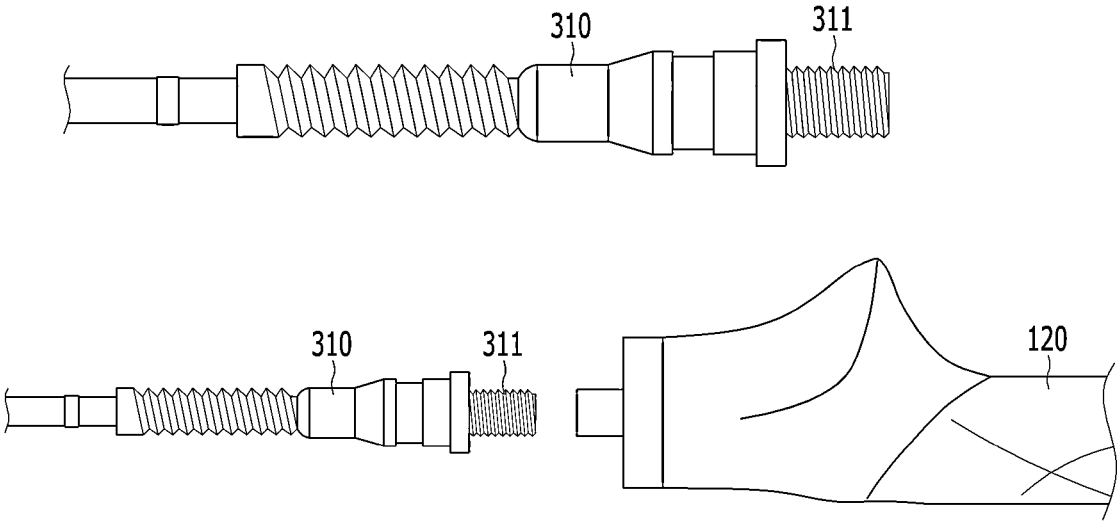
FIG. 4 is a view showing an example of a method of coupling a main body and an antenna stick guide.

FIG. 4 is a view showing an example of a method of coupling a main body 100 and an antenna stick guide 300.

As described above, the antenna stick guide 300 may be extended or inserted again in multiple sections. The main shaft 110 has a hollow inside, and the antenna stick guide 300 may be inserted into the inner space of the main shaft 110. The front end of the first stick 310 may be screw-coupled inside the main shaft 110. As described above, the cover unit 340 may be coupled while closing the rear end of the main shaft 110.

Although an example of the antenna stick guide 300 inserted into the main shaft 110 is described above, as another example, a configuration in which the front end of the first stick 310 is screw-coupled to the rear end of the main shaft 110 and the second stick 320 and the third stick 330 are inserted into or pulled out from the first stick 310 is also possible.

Figure 5:
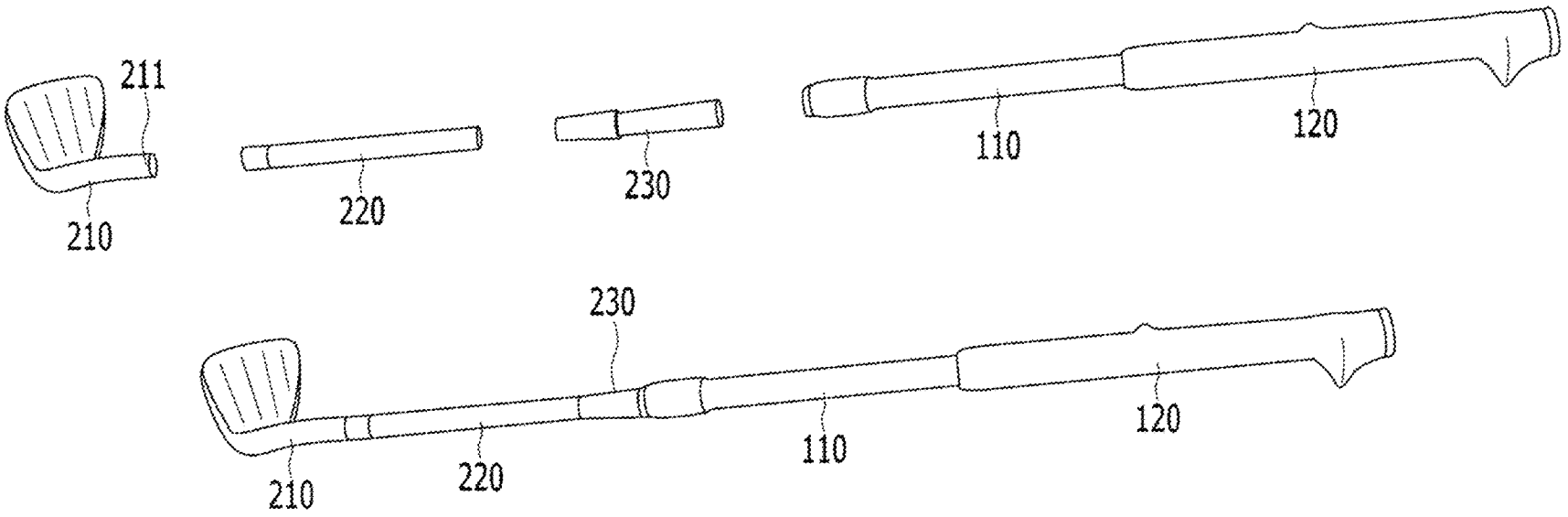
FIG. 5 is a view showing a head shaft of a portable golf swing exerciser according to an embodiment of the present invention.
Figure 6:
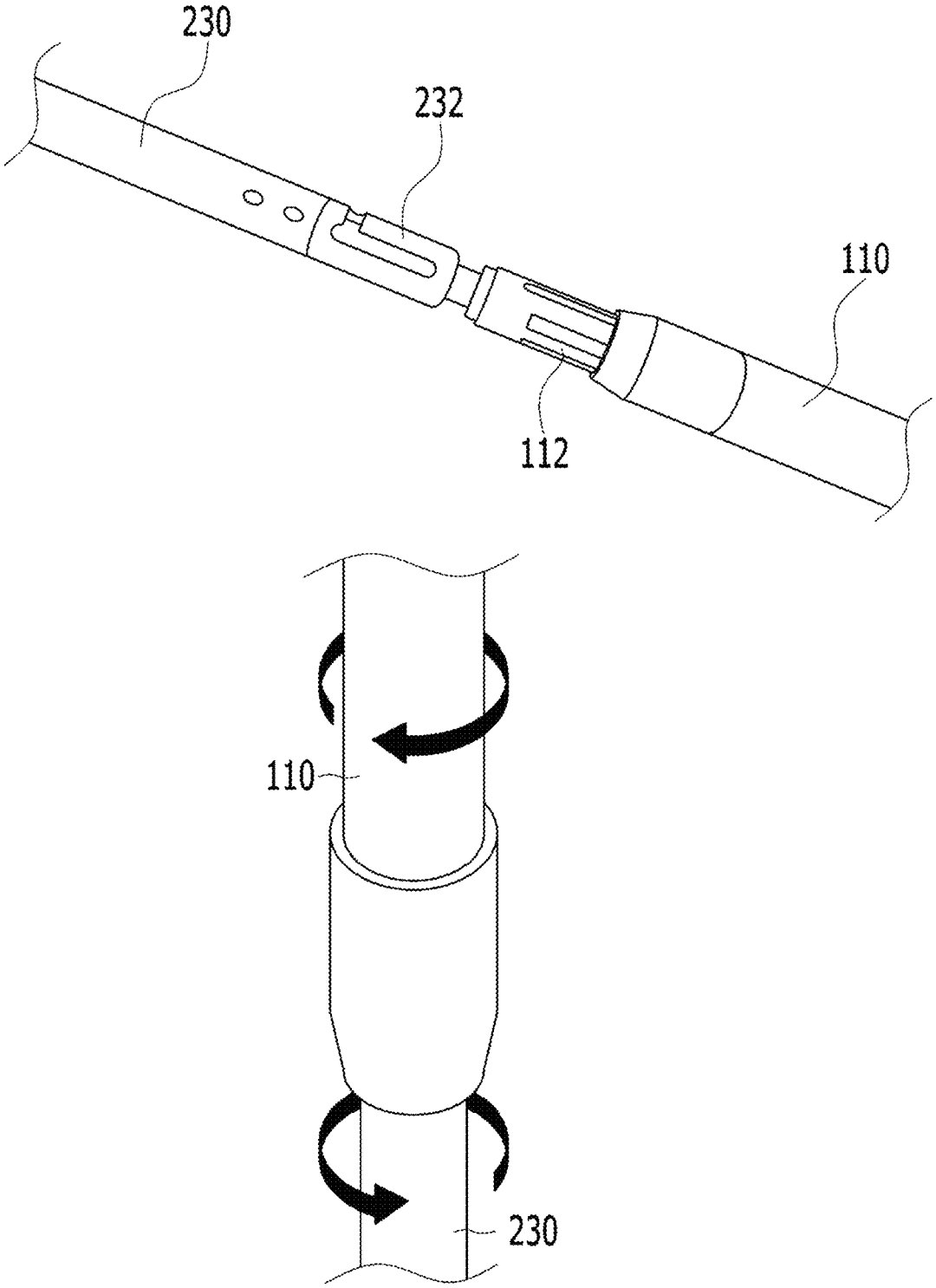
FIG. 6 is a view showing an example of a method of coupling a connection shaft.

FIG. 5 is a view showing a head shaft 200 of a portable golf swing exerciser according to an embodiment of the present invention. FIG. 6 is a view showing an example of a method of coupling a connection shaft.

In the example shown in FIG. 5, the head shaft 200 may include a head 210 and one or more connection shafts. Of course, the number of connection shafts may be increased or decreased.

The head 210 may include a head body 211 and a connection rod 212 as described above.

The one or more connection shafts may include a first connection shaft 220 detachably coupled to the connection rod 212 of the head 210, and a second connection shaft 230 detachably coupled to the rear end of the first connection shaft 220. The second connection shaft 230 may be detachably coupled to the front end of the main body 100, i.e., to the front end of the main shaft 110.

The head 210, the first connection shaft 220, and the second connection shaft 230 may be separated as shown in FIG. 5. Accordingly, owing to the separated head shaft 200, the main body 100, and the antenna stick guide 300 inserted in the main body 100, short parts may be compactly packed in a portable bag to carry.

Therefore, it is possible to easily carry and make a swing practice anytime, anywhere. In addition, an amateur may learn easily like a pro and make a practice alone while watching a video with only an instruction manual.

Meanwhile, there may be various methods of coupling the second connection shaft 230 to the main shaft 110. For example, as shown in the upper part of FIG. 6, a groove or a protrusion is formed at the front end of the main shaft 110, and a fastening guide groove is formed at the rear end of the second connection shaft 230. In addition, the second connection shaft 230 and the main shaft 110 may be aligned with each other and coupled in a rotating and locking manner as shown in the lower part of FIG. 6 and may be detached in an opposite process.

Figure 7:
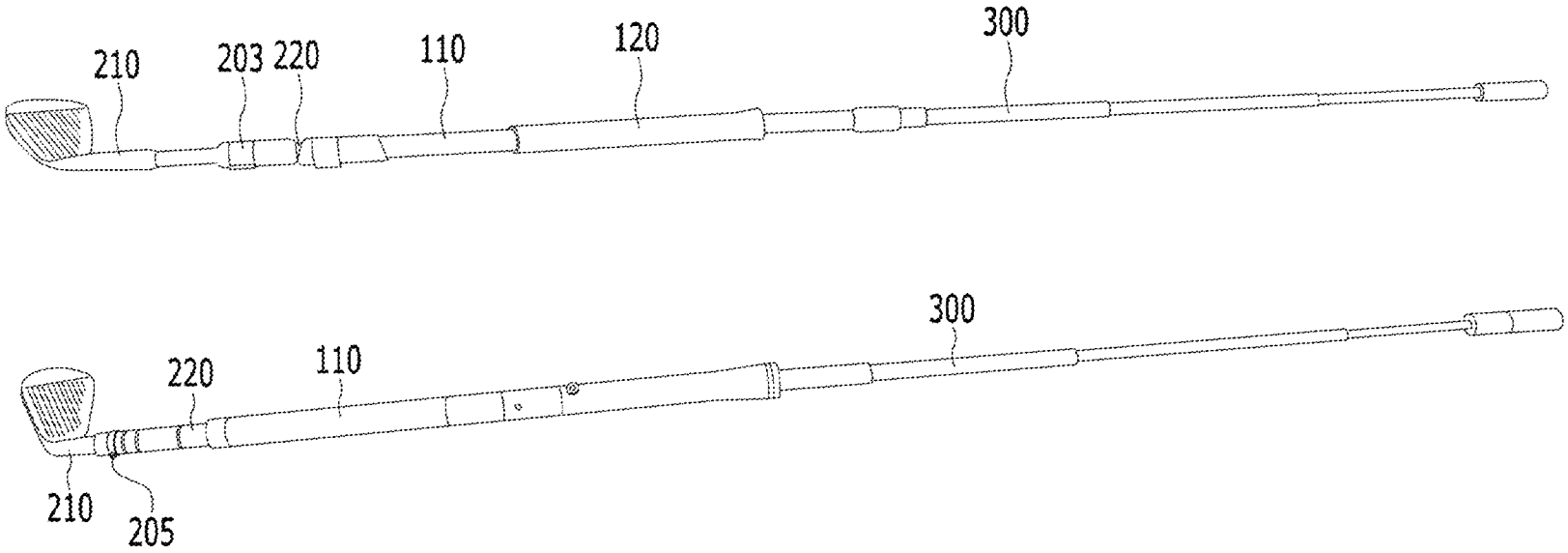
FIG. 7 is a view showing portable golf swing exercisers according to other embodiments of the present invention.
Figure 8:
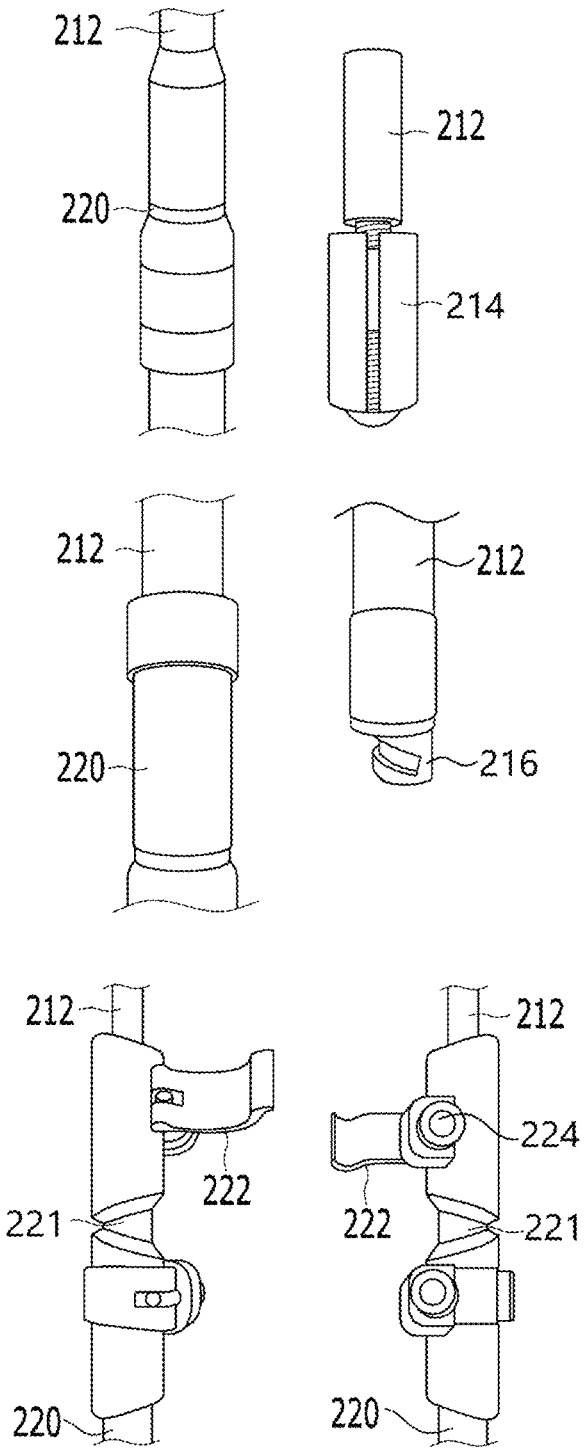
FIG. 8 is a view showing examples of coupling a head and a connection shaft.

FIG. 7 is a view showing portable golf swing exercisers according to other embodiments of the present invention. FIG. 8 is a view showing examples of coupling a head 210 and a connection shaft.

Referring to FIGS. 2 and 7, the portable golf swing exerciser may have various types of head 210 coupling methods. That is, a method of coupling the head 210 and the first connection shaft 220 may be selected according to the characteristics of a portable golf swing exerciser. For example, the portable golf swing exercisers shown in FIGS. 2 and 7 may have different coupling methods between the head 210 and the first connection shaft 220.

For example, as one among the connection rod 212 of the head 210 and the first connection shaft 220 has a female screw shape, and the other one has a male screw shape, they may be screw-coupled to each other.

Alternatively, as shown in the upper side of FIG. 8, a tightening member 214 is provided on the connection rod 212 of the head 210, and the tightening member 214 may be inserted inside the front end of the first connection shaft 220. In this case, the connection rod 212 is locked slowly according to rotation of the head 210 and may be further locked or released as much as desired. The more it is locked, the more the tightening member 214 is expanded and fixed firmly. It may be particularly suitable when the direction is predetermined.

As another example, as shown in the middle of FIG. 8, a locking groove is formed in one among the connection rod 212 of the head 210 and the first connection shaft 220, and a locking protrusion moving along the locking groove may be formed in the other one. For example, the locking groove 216 is formed at an end of the connection rod 212, and the end of the connection rod where the locking groove is formed is inserted into the end of the first connection shaft 220 where the locking protrusion is formed, and the locking protrusion may move along the locking groove and be locked. In this case, the locking may be performed in a speedy way, and particularly, it may be suitable when there is no predetermined direction in coupling between the head 210 and the first connection shaft 220.

On the other hand, as shown in the lower side of FIG. 8, a connection tightening unit 221, 222, 224 may be separately provided. After the front end of the first connection shaft 220 is inserted from the rear of a receiving unit 221 of the connection tightening unit and the connection rod 212 of the head is inserted from the front of the receiving unit 221 of the connection tightening unit, the first connection shaft 220 and the connection rod 212 are tightly attached to the receiving unit 221 by rotating pressing units 222, and indirect coupling between the first connection shaft and the head may be achieved by tightening the tightening screw 224.

In this case, it may be easily locked and unlocked with one touch regardless of the direction.

Figure 9:
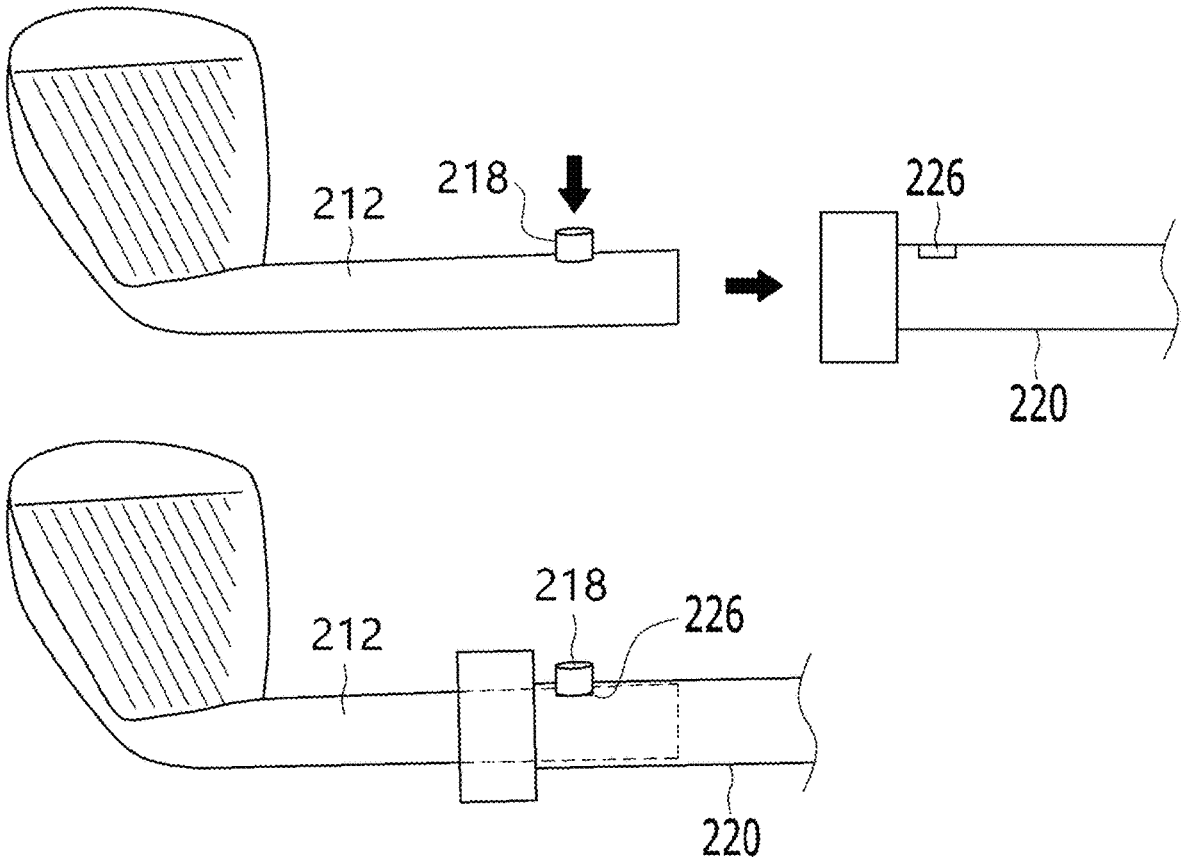
FIG. 9 is a view showing another example of coupling a head and a connection shaft.

FIG. 9 is a view showing another example of coupling a head 210 and a connection shaft.

The head 210 and the first connection shaft 220 may be coupled in another way. For example, as shown in FIG. 9, the connection rod 212 of the head 210 may have a fixing protrusion 218 restored by an elastic force. For example, the fixing protrusion 218 may be compressed and protrude by a spring installed in the connection rod 212.

A fixing hole 226 may be formed in the first connection shaft 220. The fixing protrusion 218 is pressed as the connection rod 212 of the head 210 is inserted into the first connection shaft 220, and when the fixing protrusion 218 is aligned with the fixing hole 226 while the connection rod of the head 210 rotates, the fixing protrusion 218 protrudes, and the head 210 and the first connection shaft 220 are coupled.

Figure 10:
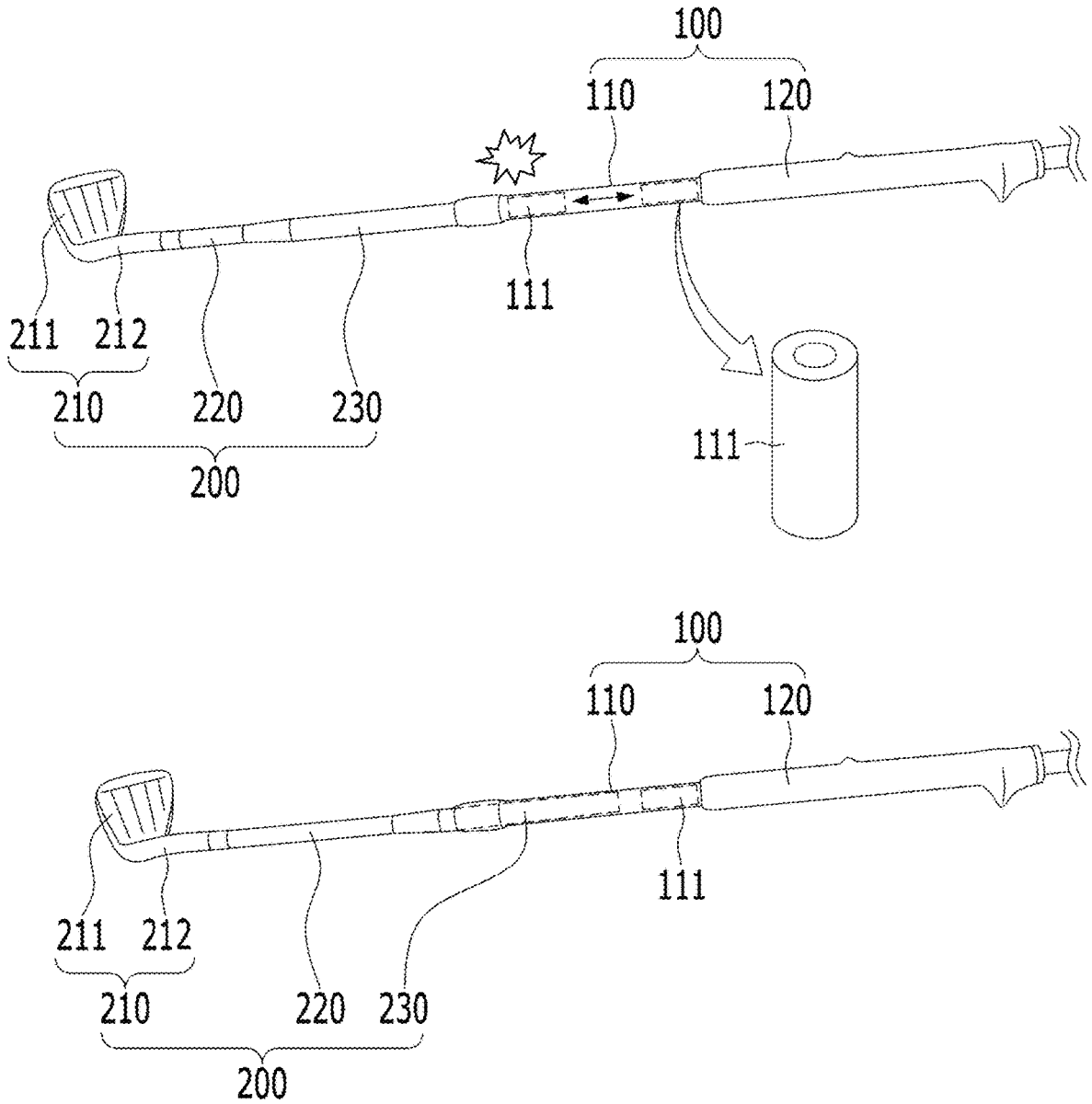
FIG. 10 is a view showing a golf swing exerciser according to still another embodiment of the present invention.

FIG. 10 is a view showing a golf swing exerciser according to still another embodiment of the present invention.

In the embodiment shown in FIG. 10, a sound generation block 111 is inserted in the main shaft 110 to inform whether the moment of impact on the golf ball is appropriate in a swing motion. The sound generation block 111 may slidingly move inside the main shaft 110.

When the main shaft 110 moves downwards by a swing, the sound generation block 111 slides down and collides with the rear end of the second connection shaft 230 coupled to the main shaft 110. Accordingly, a collision noise or sound is generated.

Therefore, the moment when a downswing of a swing motion occurs may be confirmed by the sound. By checking whether the sound is generated before or after the moment of impact on the golf ball, a wrong habit of swing may be grasped. For example, when the sound is generated on the right side at the moment of downswing, scooping has occurred, and when the sound is generated around the impact, it may be determined as a normal swing.

As described above, the antenna stick guide 300 makes it possible to visually confirm a swing trajectory of the head shaft 200 at an opposite position, and the sound generation block 111 informs whether the timing of the downswing is appropriate. Accordingly, a user may correct a swing motion or learn a desirable swing motion while confirming the swing trajectory and a vertical movement (downswing) of the swing motion.

On the other hand, when the rear end of the second connection shaft 230 is deeply inserted into the main shaft 110 and the position is fixed, generation of sound may be prevented as the sliding gap of the sound generation block 111 is removed. Therefore, a user may turn off generation of sound by doing this when needed. In this case, when the first connection shaft 220 or the connection rod 212 of the head is pulled out long to have a length appropriate to use, it may be used by offsetting length reduction of the second connection shaft 230 for turning off generation of sound.

Figure 11:
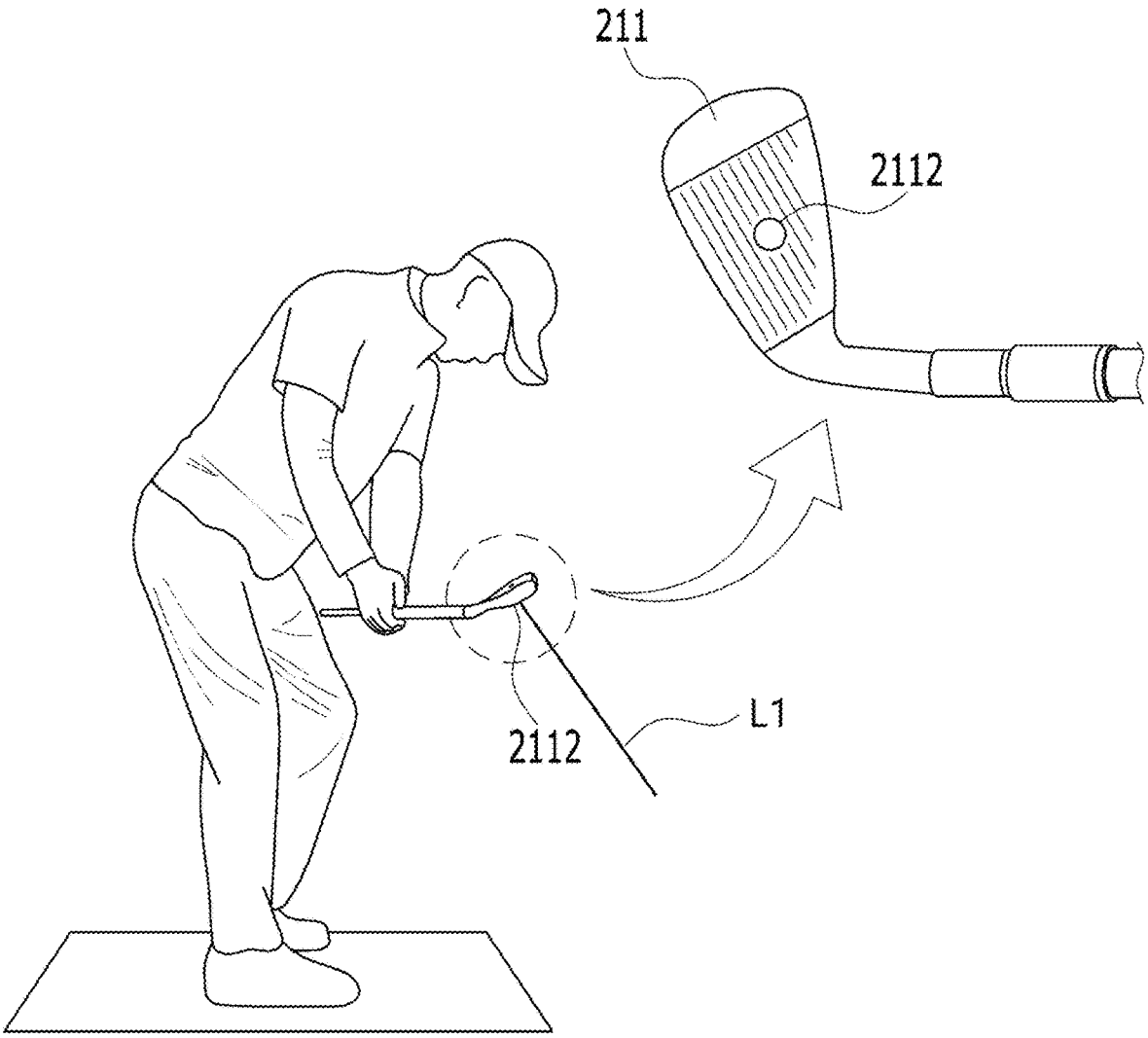
FIGS. 11 and 12 are views showing a golf swing exerciser according to still another embodiment of the present invention.
Figure 12:
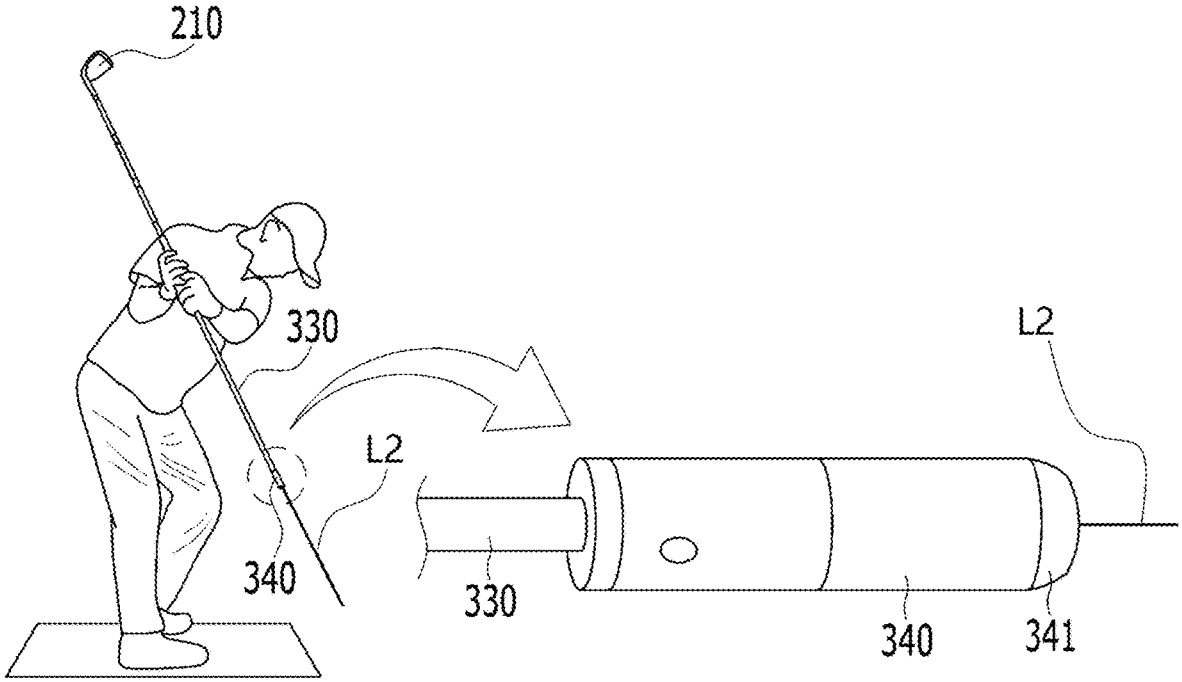

FIGS. 11 and 12 are views showing a golf swing exerciser according to still another embodiment of the present invention.

In the example shown in FIG. 11, a first laser beam generation unit 2112 is installed on the head body 211, and the example shown in FIG. 12 shows that a second laser beam generation unit 341 is installed at the rear end of the cover unit 340, which is the end portion of the antenna stick guide 300.

Since the laser generation units 2112 and 341 emit laser beams, a swing trajectory may be visually confirmed. Therefore, efficiency of training is improved. In addition, when a sheet that can be displayed by a laser beam is installed and used on the floor, the trajectory of the laser beam may remain on the sheet. It is possible to analyze the swing posture and find improvements by analyzing the remaining trajectory of the laser beam.

According to the portable golf swing exerciser of the present invention, it is possible to provide a golf swing exerciser capable of preventing sway and slice, hand first impact, down blow impact, hitting back ground, and topping.

In addition, it is possible to provide a golf swing exerciser, which can help a user to improve flying distance, learn a consistent swing mechanism, and restore self-esteem.

In addition, it helps a user to remember body muscles and correctly learn golf swing by feeling impact positions and swing paths by himself or herself within a shortest time. That is, it is convenient and easy to practice following the important swing positions of famous pros since the user may see and feel the paths of a golf club. Therefore, according to the portable golf swing exerciser, it is easy to learn detailed motions and correct wrong swing points.

In addition, a user may easily carry the portable golf swing exerciser and practice alone again anytime, anywhere. That is, the exerciser may be carried in a compact size as described above.

In addition, it enables supination, ulnar deviation, hand first, and down flow (or down blow) impact needed for impact position.

In addition, it has an excellent function in improving scooping, casting, and arm swing.

On the other hand, since the antenna stick guide 300 informs the moving direction and path of the head shaft 200, scientific practice is possible. Accordingly, it is possible to practice in detail the points such as take away, take back, backswing top, entrance of correct downswing trajectory, impact position, release, follow throw, finish, and the like.

Figure 13:
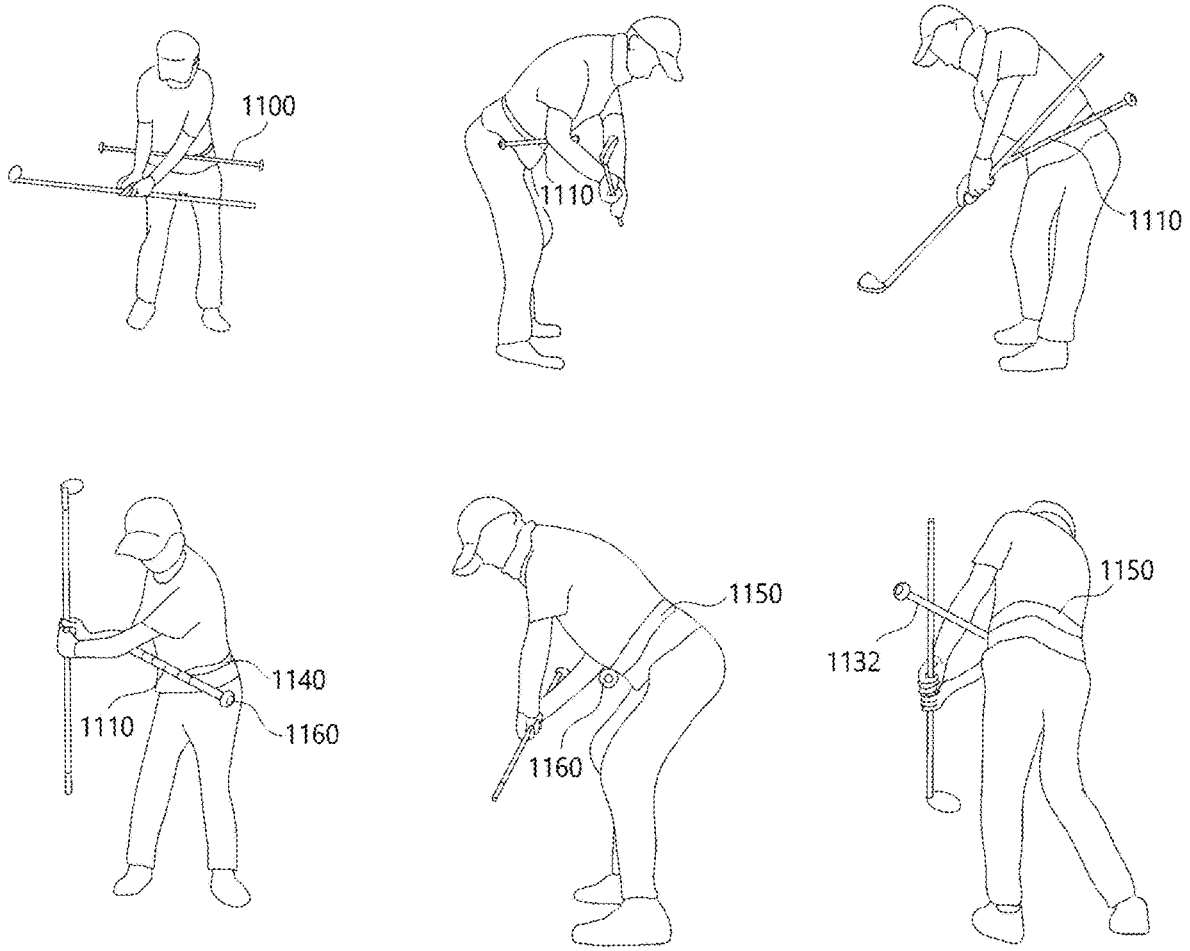
FIGS. 13 and 14 are views showing motions of practicing golf swing while wearing a portable golf swing exerciser according to another embodiment of the present invention.
Figure 14:
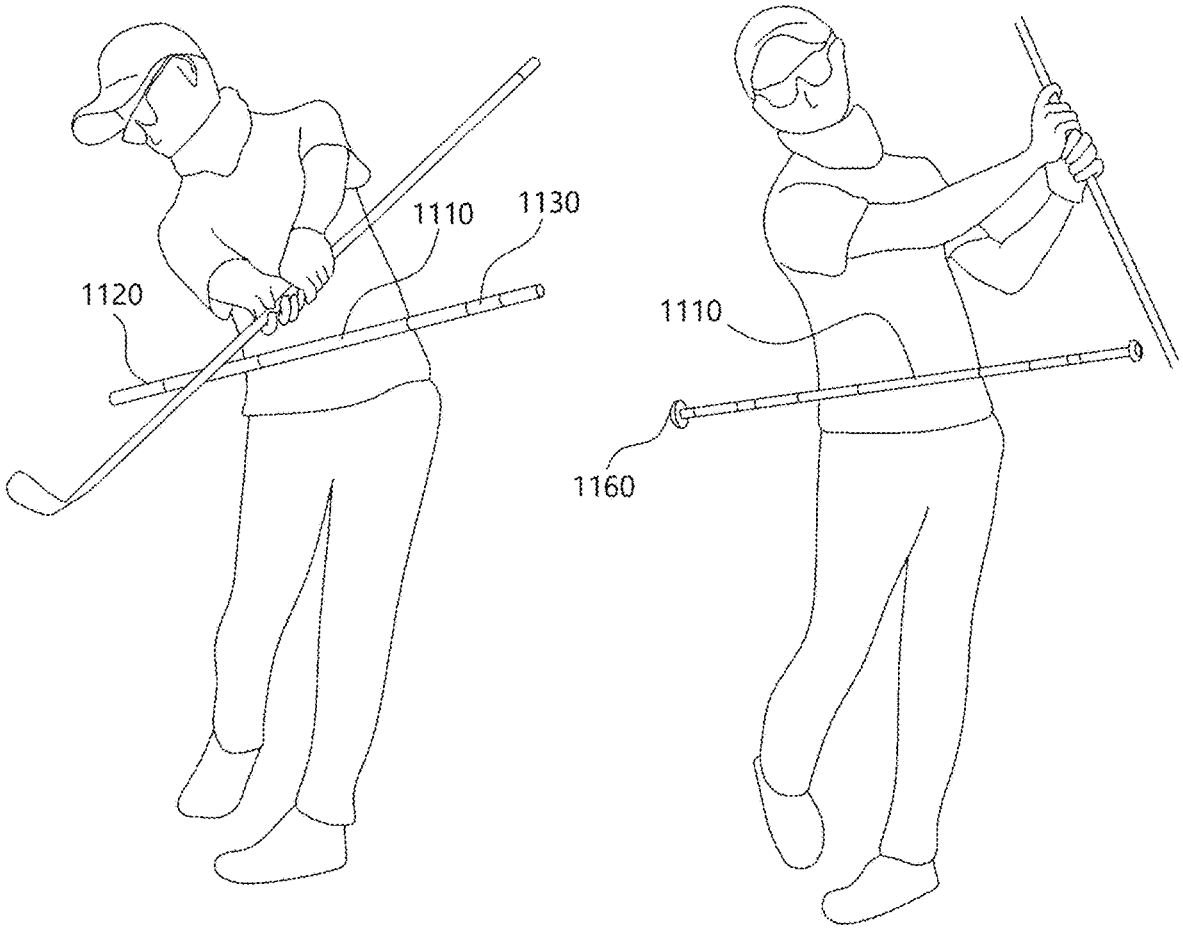

FIGS. 13 and 14 are views showing motions of practicing golf swing while wearing a portable golf swing exerciser 1100 according to still another embodiment of the present invention.

A user may wear the portable golf swing exerciser 1100 of this embodiment during a golf swing to easily recognize the rotational motion of the body. The portable golf swing exerciser 1100 may be worn near the pelvis or on the shoulder. For example, as shown in FIGS. 13 and 14, the shaft body 1110 of the portable golf swing exerciser 1100 may be worn to be positioned at the lower abdomen near the user's pelvis or at the waist near the pelvis. However, in the present invention, these are exemplary body parts and not limited to body parts such as the pelvis and/or the trunk as described above.

A user may wear the portable golf swing exerciser, hold a golf club, and practice golf swing. During a golf swing, the portable golf swing exerciser 1100 also rotates according to rotation of the body.

The portable golf swing exerciser 1100 of a bar shape of this embodiment, as shown in FIGS. 13 and 14, may help a user to visually and clearly recognize the rotational motion of the body during a golf swing such as backswing (the figure on the left side of FIG. 13), downswing (the figure in the middle of FIG. 13), impact (the figure on the right side of FIG. 13), release (the figure on the left side of FIG. 14), and finish (the figure on the right side of FIG. 14). Therefore, it is easy to correct or learn the rotational motions.

A desirable golf swing may be achieved when the order of rotating or moving both knees, pelvises and shoulders is combined with a sufficient and appropriate angle of rotation at each stage of the golf swing. The desirable forms of the rotating or moving sequence and the rotation angle may be provided as a textbook.

A user or a coach may easily grasp, correct, or learn the rotation order, rotation angle, and the like by visually seeing the portable golf swing exerciser 1100.

Figure 15:
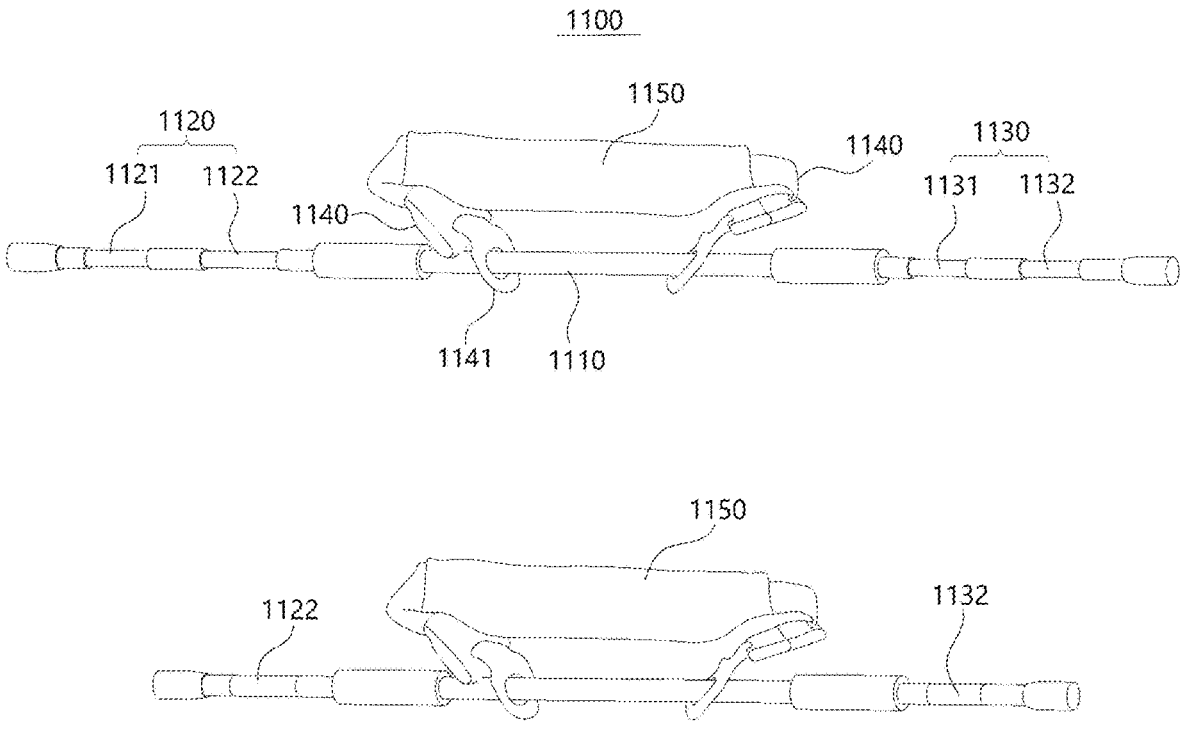
FIG. 15 is a view showing a portable golf swing exerciser according to another embodiment of the present invention.

FIG. 15 is a view showing a portable golf swing exerciser 1100 according to still another embodiment of the present invention.

The portable golf swing exerciser 1100 may include a shaft body 1110, a first extension shaft 1120, a second extension shaft 1130, a connection belt 1140, and a support pad 1150.

The shaft body 1110 has a bar shape formed in the shape of a pipe having a hollow inside. The shaft body 1110 may be positioned to be extended left and right near the pelvises or shoulders of a user when the portable golf swing exerciser 1100 is worn.

The first extension shaft 1120 is coupled to one end of the shaft body 1110 to be extendable.

The second extension shaft 1130 is coupled to the other end of the shaft body 1110 to be extendable.

One end of the connection belt 1140 is connected to the shaft body 1110, and the shaft body 1110 may be tightly attached to the user's body when it is tightened. That is, in the case of the example shown in FIGS. 15 and 16, when the portable golf swing exerciser 1100 is worn on the waist or the pelvis, the support pad 1150, the connection belt 1140, and the shaft body 1110 form a closed curve, and the portable golf swing exerciser 1100 may be worn in a way of inserting the body in the closed curve.

A connection ring 1141 having a fastening hole into which the shaft body 1110 is inserted is formed at an end of each connection belt 1140, and the connection ring 1141 may slide along the shaft body 1110. Accordingly, the portable golf swing exerciser 1100 may be worn by moving the connection ring 1141 according to the body size.

Of course, the portable golf swing exerciser 1100 may be worn in a method of opening the connection ring 1141 of the connection belt 1140 to separate the shaft body 1110 from the connection belt 1140, easily wearing by wrapping the connection belt 1140 around the waist near the pelvis, coupling the connection ring 1141 of the connection belt 1140 to the shaft body 1110 again, and adjusting the length to tighten the connection belt 1140.

The support pad 1150 is connected to the other ends of the two connection belts 1140, and as the two connection belts 1140 are tightened, the support pad 1150 is tightly attached to the user's body from the opposite side of the shaft body 1110.

When a user practices golf swing while wearing the portable golf swing exerciser 1100 like this, the shape of rotational motions of the user's body may be easily recognized from the trajectories of the end portion of the first extension shaft 1120 and the end portion of the second extension shaft 1130.

Figure 16:
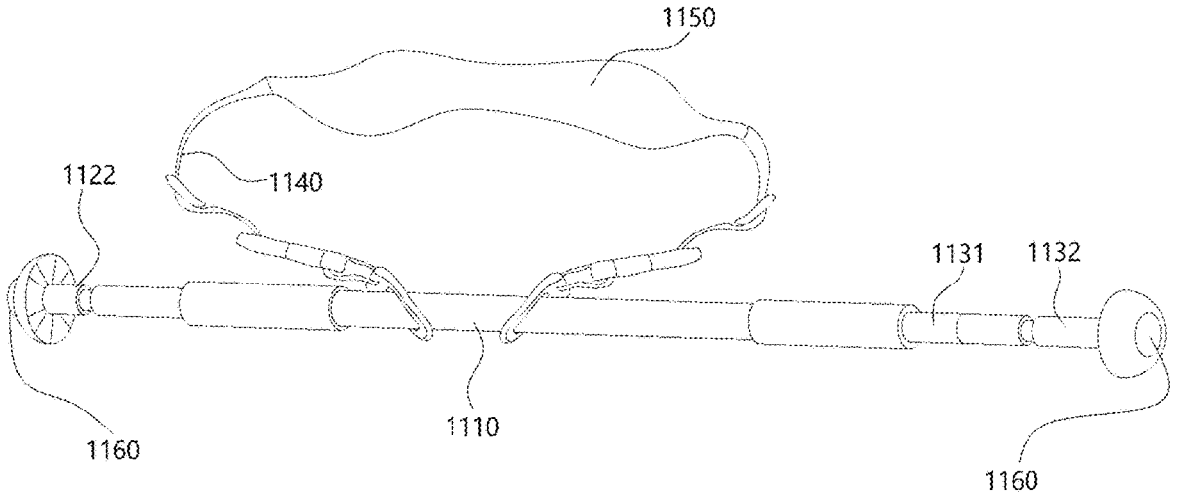
FIG. 16 is a view showing a portable golf swing exerciser according to still another embodiment of the present invention.
Figure 17:
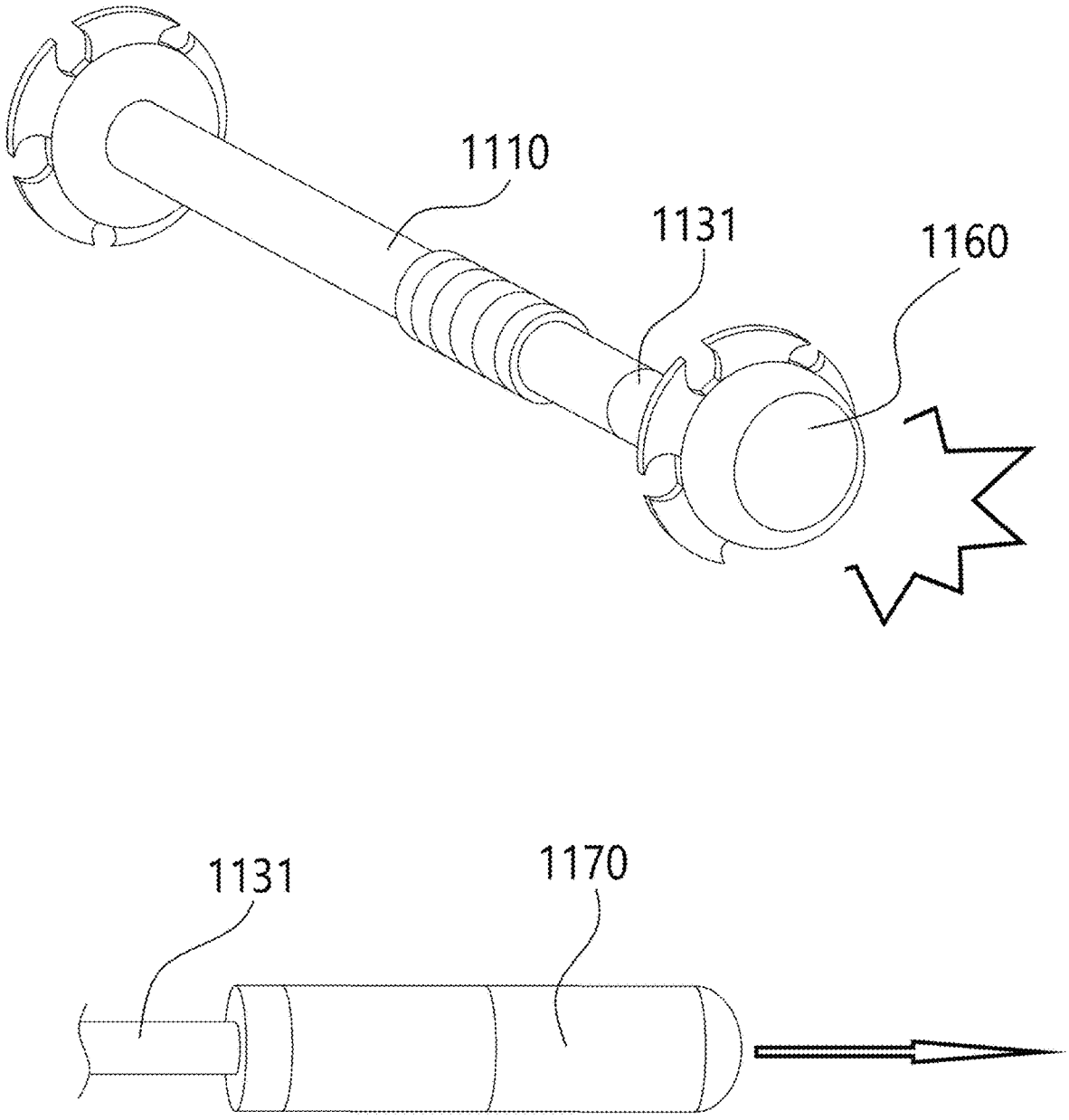
FIG. 17 is a view showing examples of a display unit of a portable golf swing exerciser.

FIG. 16 is a view showing a portable golf swing exerciser 1100 according to another embodiment of the present invention. FIG. 17 is a view showing examples of the end of a portable golf swing exerciser 1100.

An LED 1160 that can be turned on and off by a user may be installed at the end portion of the first extension shaft 1120 and the end portion of the second extension shaft 1130 (see the figure in the upper portion of FIG. 17). In this case, when a user practices golf swing while the LED 1160 emits light, the trajectories of the end portion of the first extension shaft 1120 and the end portion of the second extension shaft 1130 may be visually and more easily recognized. In some cases, the trajectories may be sensed by installing an optical sensor for sensing the light emitted from the LED 1160 around the user.

As another example, a laser generator 1170 for emitting a beam in the longitudinal direction of the shaft body 1110 may be installed at the end portion of the first extension shaft 1120 and the end portion of the second extension shaft 1130.

In this case, the laser beam may make it possible to visually and more easily recognize the trajectories of the end portion of the first extension shaft 1120 and the end portion of the second extension shaft 1130. Furthermore, a trajectory sensor capable of receiving laser beams may be installed around the user to sense the trajectories, and the trajectories may be analyzed by software.

Figure 18:
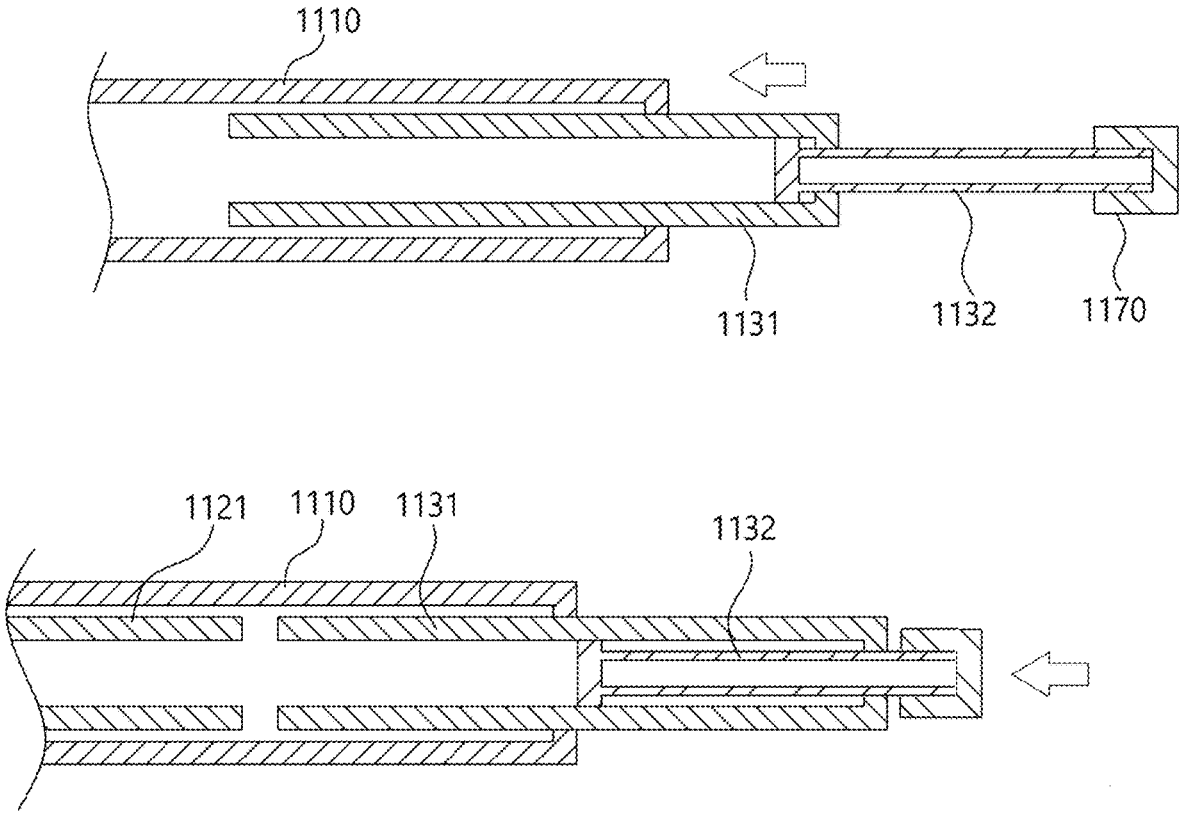
FIG. 18 is a view showing an example of a length adjustment structure of a portable golf swing exerciser.

FIG. 18 is a view showing an example of a length adjustment structure of a portable golf swing exerciser 1100.

The portable golf swing exerciser 1100 may be carried in a bag or while being attached to the body. In this case, the portable golf swing exerciser 1100 may be carried by reducing the length.

To this end, the first extension shaft 1120 and the second extension shaft 1130 may have a multi-section length adjustment structure to be inserted in or pulled out in multiple sections to adjust the length.

For example, the first extension shaft 1120 and the second extension shaft 1130 may include first shafts 1121 and 1131 and second shafts 1122 and 1132. The first shafts 1121 and 1131 may be inserted into or pulled out from the shaft body 1110 in a sliding manner. The second shafts 1122 and 1132 may be inserted into or pulled out from the first shafts 1121 and 1131 in a sliding manner.

Various types may be applied to fix the shaft body 1110, the first shafts 1121 and 1131, and the second shafts 1122 and 1132.

For example, as one of them has a female thread shape, and another one coupled thereto has a male thread shape, they may be screw-coupled together.

Alternatively, one of them may be provided with a tightening member, and the other one may be inserted therein. In this case, it is locked slowly according to rotation and may be further locked or released as much as desired. The more it is locked, the more the tightening member 214 is expanded and fixed firmly. It may be particularly suitable when the direction is predetermined.

As another example, a locking groove may be formed in one of them, and a locking protrusion moving along the locking groove may be formed in the other one. For example, locking grooves are formed at the ends of the first shafts 1121 and 1131, and the ends of the first shafts 1121 and 1131 having the locking grooves are inserted into the ends of the shaft body 1110 having the locking projections, and the locking protrusions may move along the locking grooves and be locked. In this case, the locking may be performed in a speedy way.

As an example of fixing like this, FIGS. 6 and 8 may be referred.

Figure 19:
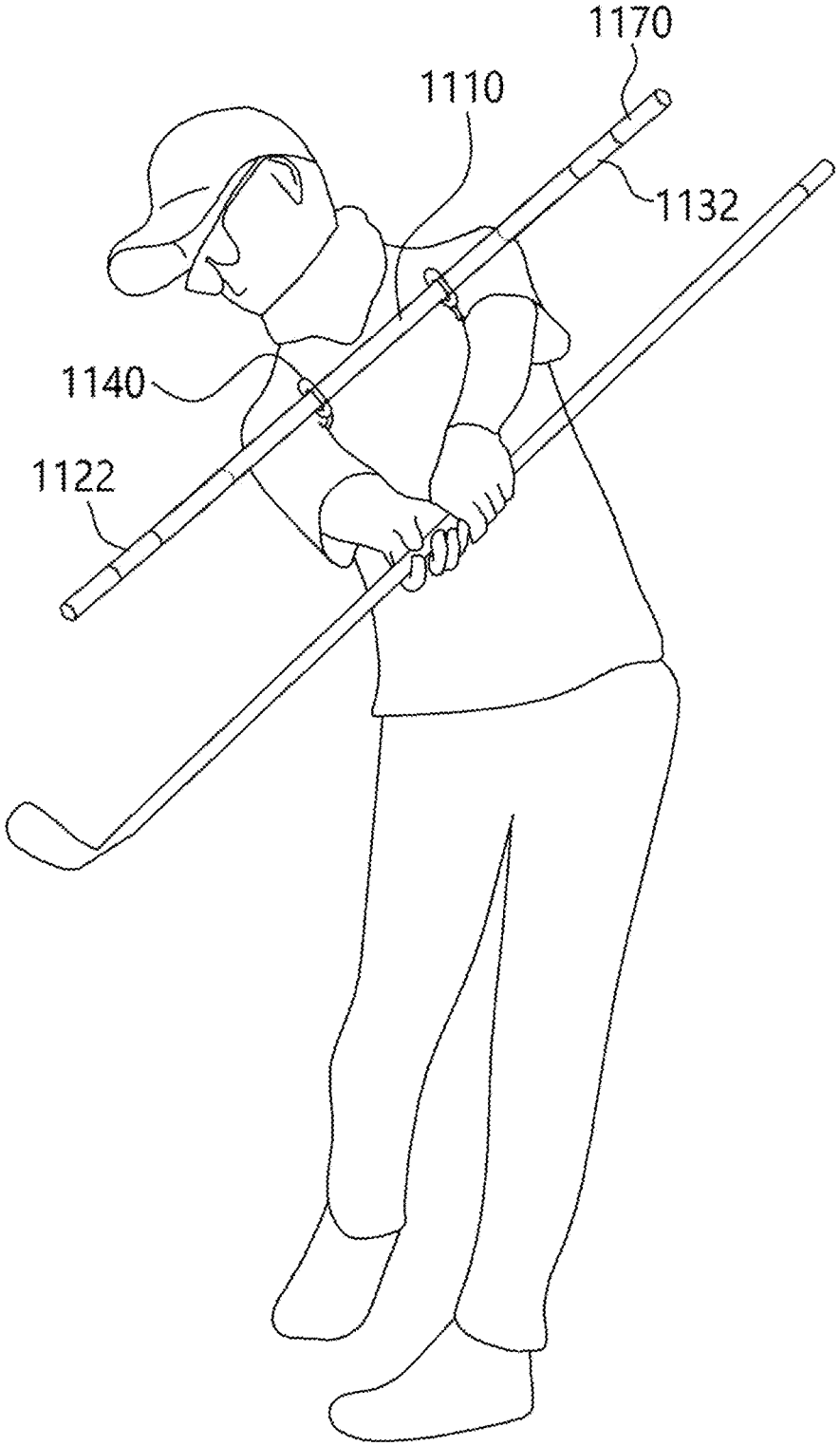
FIG. 19 is a view showing a portable golf swing exerciser according to still another embodiment of the present invention.

FIG. 19 is a view showing a portable golf swing exerciser 1100 according to still another embodiment of the present invention.

The portable golf swing exerciser 1100 may be worn to position the shaft body 1110 on the shoulders near the user's chest or on the back shoulders. In this case, the connection belt 1140 and the support pad 1150 may be changed or modified to be convenient for shoulder wearing.

In the case of the shoulder-wearing type exerciser shown in FIG. 19, two connection belts 1140 may be formed to form a closed curve by themselves so as to be worn on both shoulders. The connection belts 1140 each forming a closed curve may be connected to the support pad 1150 (positioned on the back near the shoulders of the user in FIG. 19). Alternatively, the support pad may be omitted. The user may wear the exerciser by inserting an arm into the closed curve formed by the connection belt 1140 at one side, coupling the connection ring 1141 to the shaft body 1110 using a hand while the connection belt 1140 at the other side is released, and pulling and tightening the connection belts 1140 on both sides.

In this way, when a user practices golf swing while wearing the shoulder-wearing type portable golf swing exerciser, the rotation angles of the shoulders and the rotation time difference between the left and right shoulders may be visually and effectively confirmed. Of course, even in this case, light emission of the LED 1160 or the laser beam may further increase the effect as described above.

Figure 20:
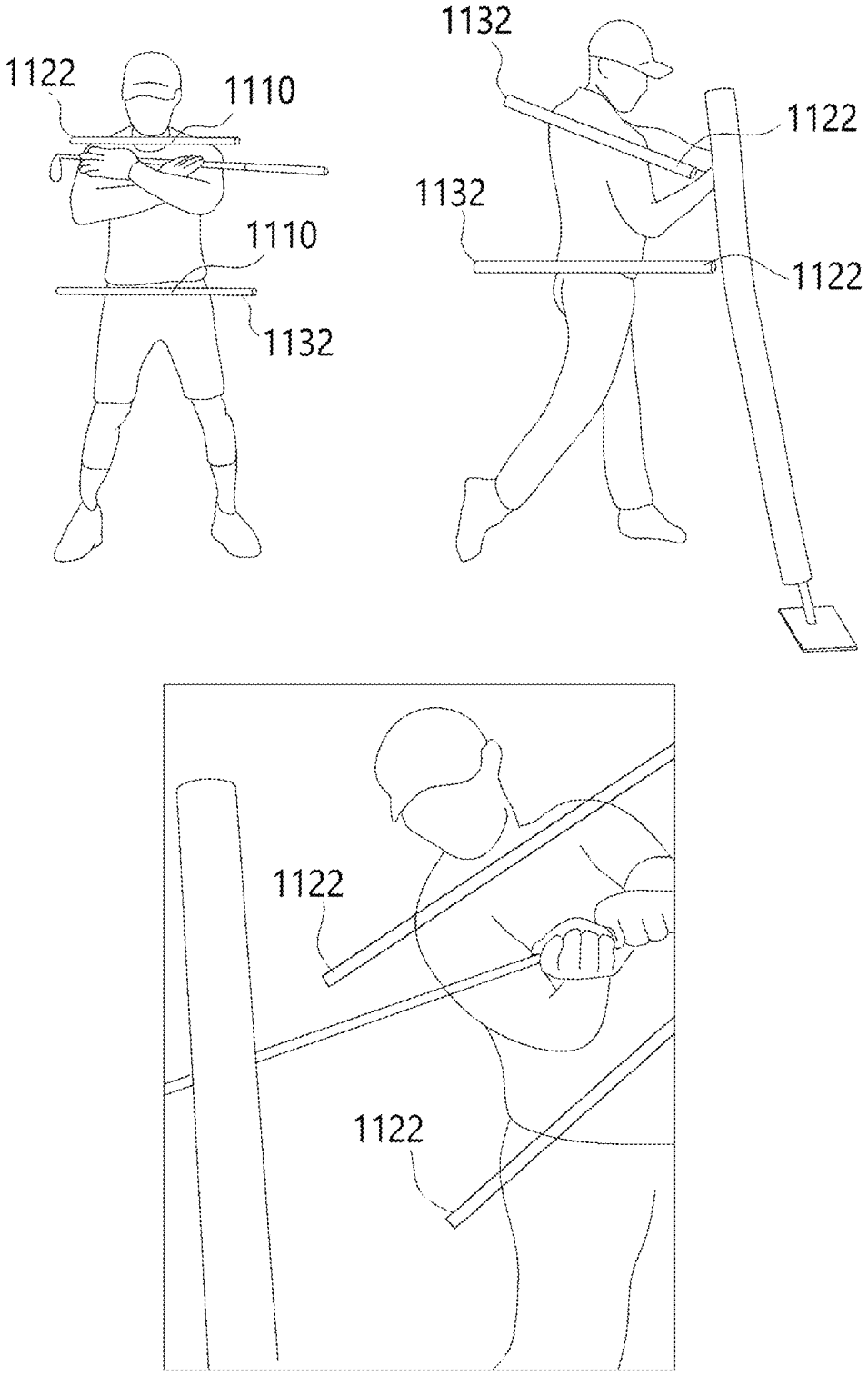
FIG. 20 is a view showing a method of practicing golf swing while wearing portable golf swing exercisers according to embodiments of the present invention.
Figure 21:
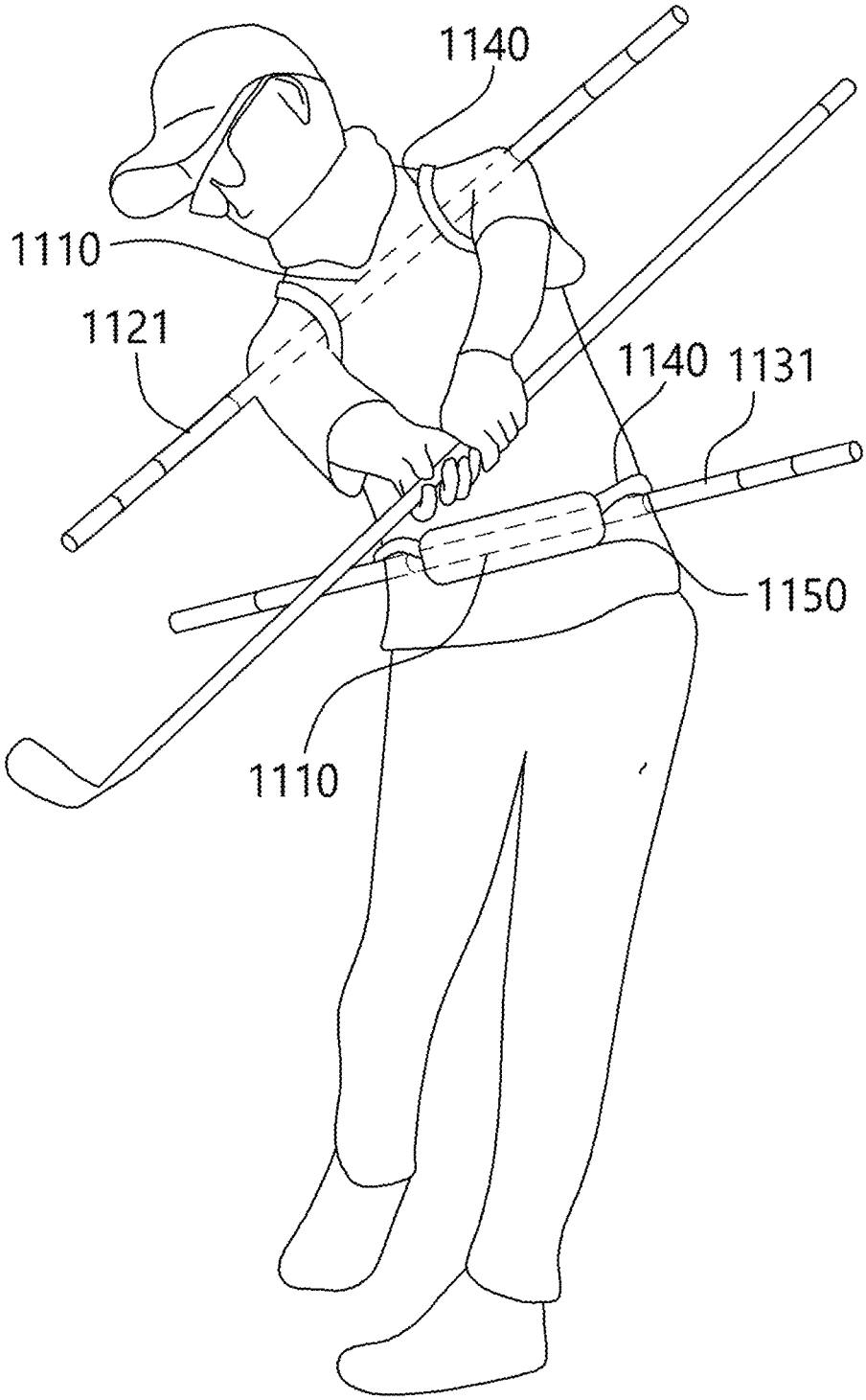
FIG. 21 is a view showing a method of practicing golf swing while wearing portable golf swing exercisers according to embodiments of the present invention.

FIG. 20 is a view showing a method of practicing golf swing while wearing portable golf swing exercisers 1100 according to embodiments of the present invention. FIG. 21 is a view showing a method of practicing golf swing while wearing portable golf swing exercisers 1100 according to embodiments of the present invention.

A user may practice golf swing as shown in FIG. 20 while wearing both the portable golf swing exerciser 1100 worn on the pelvis (or waist) as described in FIGS. 13 to 18 and the portable golf swing exerciser 1100 worn on the shoulders as described in FIG. 19. These portable golf swing exercisers 1100 may be worn to position the shaft body 1110 on the back side, or on the lower abdomen or the shoulder side above the chest as shown in FIG. 21 (see FIG. 22).

It is easy to grasp the rotation order and the rotation angle of both knees, pelvises and shoulders from light emission of the LEDs 1160 installed at the end portion of the first extension shaft 1120 and the end portion of the second extension shaft 1130 or the laser beam of the laser generator 1170. Accordingly, it is possible to easily grasp the shape of the rotational motion and correct golf swing at each stage of backswing, downswing, impact, release, or finish.

For example, in doing a backswing (see the figure on the left side of FIG. 13), the order and the inclination angle of moving the pelvis may be grasped and corrected according to desirable posture information or a textbook transmitted through a smartphone.

In doing a downswing (see the picture in the middle of FIG. 13), a method of putting the left pelvis in without having the right pelvis come out and how much the left pelvis is put in may be informed. The putting depth should be large to guarantee power and to smoothly perform the next process of the swing.

When an impact is applied (see the figure on the right side of FIG. 13), the rotation method and the rotation position of the right pelvis may be confirmed. In addition, a method of confirming and preventing occurrence of upper body slide when an impact is applied may be learned. In addition, it may be learned how to keep the right pelvis in a relevant place and stretch the left pelvis when an impact is applied.

In addition, in doing a release motion (see the figure on the left side of FIG. 14), it is important to maintain the spinal angles above the left pelvis and below the right pelvis, and the spinal angles may be confirmed and corrected by the portable golf swing exerciser 1100 while doing the current motion.

In doing a finish motion (see the figure on the right side of FIG. 14), the pelvises should rotate to face the belly button toward the target, and this may be confirmed and corrected by the portable golf swing exerciser 1100 while doing the current motion.

By grasping and correcting swing motion through the portable golf swing exerciser 1100, the following points may be felt vividly, and experience values may be improved.

The lower body goes first, not goes fast.

The arms are fit to "turn", not the turn is fit to "arms".

The basics of squat for downswing is to fold the left pelvis, not to turn it.

The meaning of "turn" in golf is close to movement of position rather than a turn.

Feeling, method, and sequence (harmony of body, arm, and club) of delay hitting (delayed impact)

It may be known how much and how the pelvises should turn at the finish.

It may be known how the right shoulder should turn before the impact.

The user may understand how the body feels turn of the left pelvis in place and turn of the right pelvis diagonally in the case of back swinging, and turn of the right pelvis in place and folding of the left pelvis in the case of downswing, and a degree of folding.

Feeling and understanding of down blow impact and hand first impact.

Cause and understanding of slide (→slice?), hitting back ground, topping, and reduction of flying distance.

Figure 22:
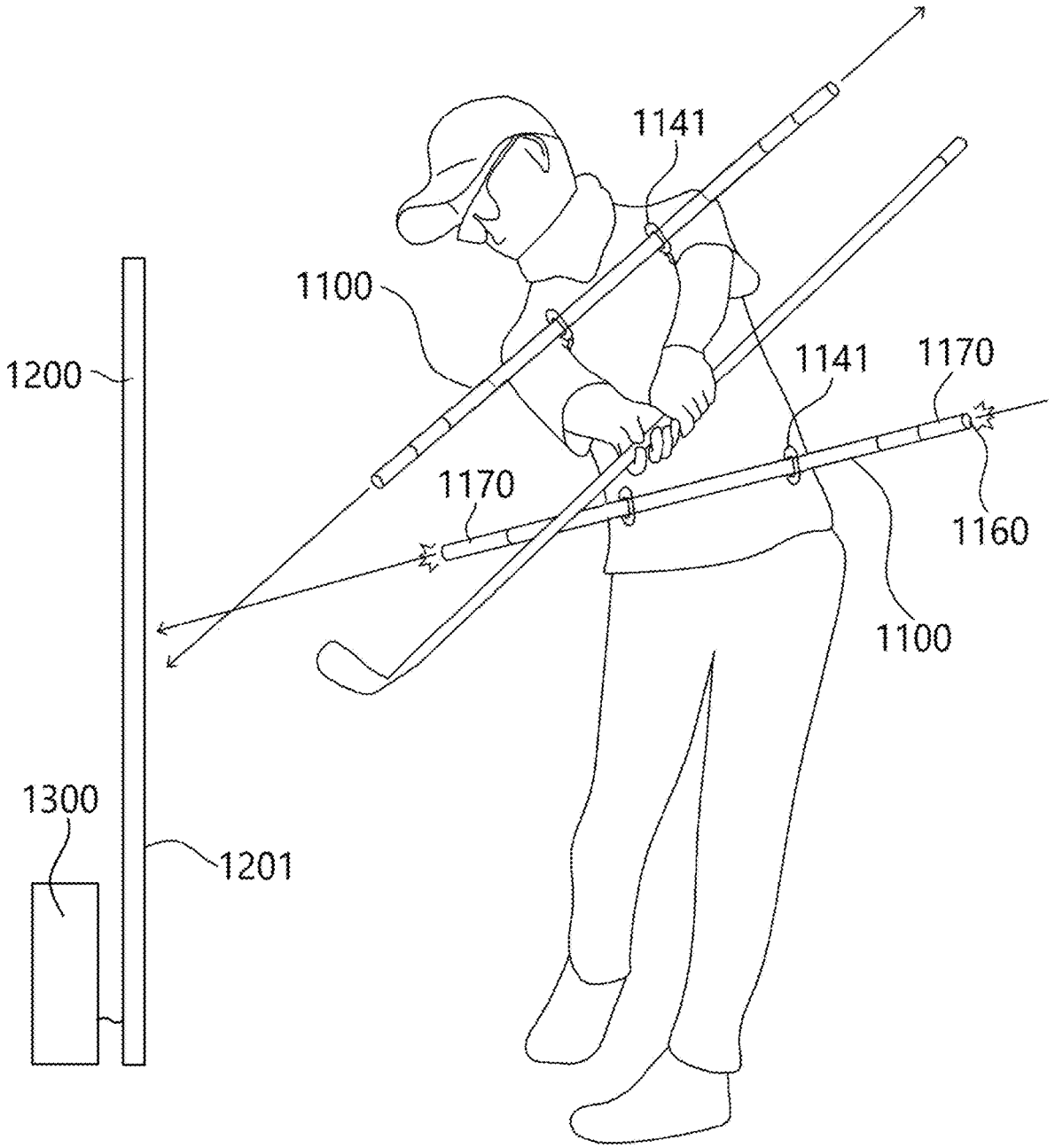
FIG. 22 is a view showing a method of practicing golf swing while wearing portable golf swing exercisers according to embodiments of the present invention.
Figure 23:
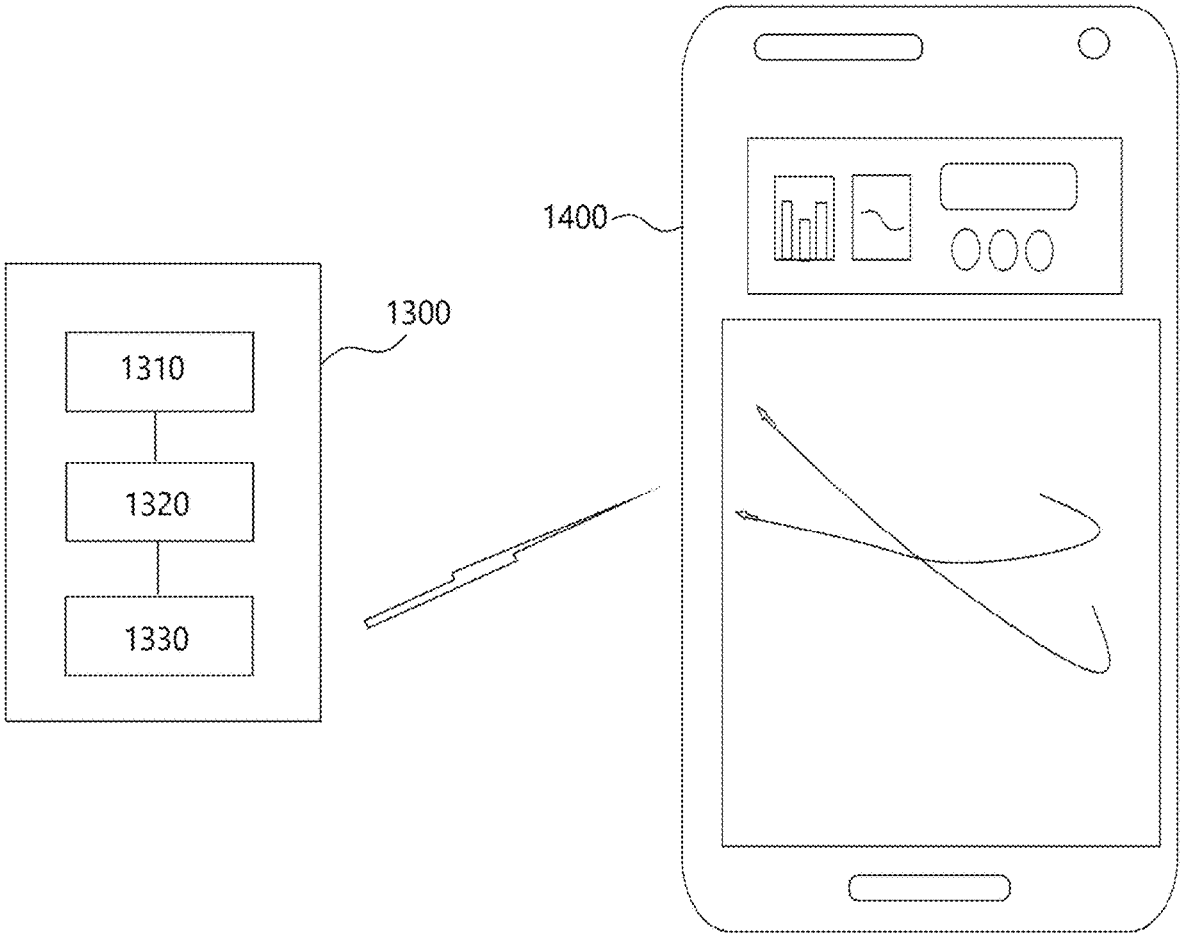
FIG. 23 is a view showing the operation of a golf swing motion information providing device that provides information on the shape of rotational motions of a body during a golf swing practice.

FIG. 22 is a view showing a method of practicing golf swing while wearing portable golf swing exercisers 1100 according to embodiments of the present invention. FIG. 23 is a view showing the operation of a golf swing motion information providing device that provides information on the shape of rotational motions of a body during a golf swing practice.

A device for providing golf swing motion information may include a portable golf swing exerciser 1100, a trajectory sensor 1200, and a control unit 1300.

The portable golf swing exerciser 1100 may be worn to position the shaft body 1110 on the back side as shown in FIG. 21, or on the lower abdomen or the shoulder side above the chest as shown in FIG. 22.

The LED 1160 or the laser generator 1170 may be installed on or detachably attached to the end portion of the first extension shaft 1120 and the end portion of the second extension shaft 1130 in the form of a module. When a user installs the laser generator 1170 and makes a swing motion as needed, the trajectory sensor 1200 installed next to it may receive a laser beam as shown in FIG. 22. Accordingly, the trajectory sensor 1200 may sense the trajectories of the end portion of the first extension shaft 1120 and the end portion of the second extension shaft 1130.

The trajectory sensor 1200 may have a sensing surface 1201 for sensing a beam emitted from the laser generator 1170. The sensing surface 1201 may be a flat surface or a curved surface. A plurality of optical sensors may be provided on the sensing surface 1201.

The control unit 1300 may be a computer wiredly or wirelessly connected to the trajectory detector 1200. The control unit 1300 may include a receiving unit 1310 for receiving sensed trajectories, an analysis unit 1320 for analyzing the received trajectories, and a transmission and reception unit 1330 for transferring a result of analyzing the shape of the trajectories (swing motion) to a user and receiving a handling signal.

For example, the control unit 1300 may include custom-tailored software, and the analysis unit 1320 may generate rotational motion shape information including the rotation angles of both knees, the rotation angles of the pelvises, the rotation angles of the shoulders, and the rotation order of the knees, the pelvises, and the shoulders using the user's body information input in advance and the sensed trajectories.

The control unit 1300 may transmit the rotational motion shape information to the user's smartphone through the transmission unit 1330.

Through an app installed in the smartphone 1400, the trajectories observed or sensed from the portable golf swing exerciser 1100 during the golf swing motion are displayed on the display unit as shown in FIG. 23, and the analyzed result may be displayed through the user app.

Display of the result may include text or image information which informs the points to be corrected for a desirable golf swing.

It should be understood that the description of the present invention described above is for illustrative purposes and those skilled in the art can easily modify the present invention in other specific forms without changing the technical spirit or essential features of the present invention. Accordingly, it should be understood that the above-described embodiments are only exemplary and are not restrictive. For example, each constitutional component described as a singular form may be embodied in a distributed form, and in the same manner, constitutional components described as being distributed may be embodied in a combined form.

The scope of the present invention is indicated by the claims described below, and it is to be interpreted that the meaning and scope of the claims and all changes or modified forms derived from the equivalent concepts thereof are included in the scope of the present invention.

What is claimed is:

1. A golf swing motion information providing device for providing information on a shape of rotational motion of a user's body during a golf swing practice, the device comprising:

a portable golf swing exerciser configured to be worn on the user's body during the golf swing practice performed by holding and swinging a golf club to recognize rotational motion of the user's body, the exerciser being separate from the golf club, the exerciser comprising:

a shaft body configured to be positioned to be extended left and right near pelvises or shoulders of the user when the portable golf swing exerciser is worn;

a first extension shaft coupled to one end of the shaft body to be extendable;

a second extension shaft coupled to another end of the shaft body to be extendable;

two connection belts, each belt having an end connected to the shaft body to tightly attach the shaft body to the user's body when tightened;

a support pad connected to the two connection belts to be tightly attached to a back side of the user's body opposite to a front side of the user's body onto which the shaft body is attached as the two connection belts are tightened; and two laser generators, one of the two laser generators disposed at an end portion of the first extension shaft and the other of the two laser generators disposed at an end portion of the second extension shaft, each laser generator being configured for emitting a beam in a longitudinal direction of the shaft body, the device further comprising:

a trajectory sensor for sensing trajectories of the end portion of the first extension shaft and the end portion of the second extension shaft; and a control unit for analyzing the sensed trajectories and transferring an analysis result to the user, wherein the trajectory sensor has a sensing surface for sensing a beam emitted from the two laser generators, and wherein the control unit is configured to generate rotational motion shape information including at least one of rotation angles of both knees, rotation angles of pelvises, rotation angles of shoulders, and a rotation order of the knees, the pelvises, and the shoulders from information of the user's body provided in advance and the sensed trajectories, and to transmit the rotational motion shape information to a user's terminal.

2. The device according to claim 1, wherein the exerciser further comprises an LED light that is configured to be turned on and off by the user and disposed at the end portion of the first extension shaft or the end portion of the second extension shaft.

3. The device according to claim 1, wherein each of the first extension shaft and the second extension shaft has a multi-section length adjustment structure that is configured to be inserted in or pulled out in multiple sections to adjust a length thereof.

4. The device according to claim 1, wherein the exerciser further comprises a connection ring having a fastening hole into which the shaft body is inserted and disposed at the end of each connection belt, the connection ring being configured to slide along the shaft body.

5. The device according to claim 1, wherein the exerciser is configured to be worn to position the shaft body at a lower abdomen near the user's pelvises or at a waist near the pelvises.

6. The device according to claim 1, wherein the exerciser is configured to be worn to position the shaft body on the shoulders near the user's chest or on back shoulders.

* * * * *